US007976199B2

(12) United States Patent
Berns et al.

(10) Patent No.: US 7,976,199 B2
(45) Date of Patent: Jul. 12, 2011

(54) APPARATUS AND METHOD FOR PATHWAY OR SIMILAR LIGHTING

(75) Inventors: James J. Berns, Muscatine, IA (US); Thomas A. Stone, University Park, IA (US)

(73) Assignee: Musco Corporation, Oskaloosa, IA (US)

( * ) Notice: Subject to any disclaimer, the term of this patent is extended or adjusted under 35 U.S.C. 154(b) by 469 days.

(21) Appl. No.: 12/113,838

(22) Filed: May 1, 2008

(65) Prior Publication Data

US 2008/0273333 A1 Nov. 6, 2008

Related U.S. Application Data

(60) Provisional application No. 60/915,158, filed on May 1, 2007.

(51) Int. Cl.
*F21V 7/00* (2006.01)
*F21S 8/00* (2006.01)

(52) U.S. Cl. ..... 362/298; 362/147; 362/431; 362/301; 362/346

(58) Field of Classification Search ..... 362/147, 362/153.1, 414, 431, 294, 297, 298, 301, 362/345, 346, 373
See application file for complete search history.

(56) References Cited

U.S. PATENT DOCUMENTS 5,105,347 A * 4/1992 Ruud et al. ..... 362/268
5,906,425 A * 5/1999 Gordin et al. ..... 362/153.1
6,402,337 B1 * 6/2002 LeVasseur et al. ..... 362/153.1
6,530,675 B1 * 3/2003 Van Etten ..... 362/267
6,679,621 B2 1/2004 West et al.
2002/0118542 A1 * 8/2002 LeVasseur ..... 362/351

OTHER PUBLICATIONS

Arcadian Lighting, "Bollards and Pagoda Lights at Deep Discount", http://www.arcadianlighting.com/bollard-and-pagoda-lights.html, retrieved Apr. 29, 2007, 4 pages.
Philips, Technical Datasheet DS25 "Power Light Source Luxeon Emitter", http://www.philipslumileds.com/pdfs/DS25.pdf, May 2007, 19 pages.
Luxdrive by LEDdynamics, "3021/3023 BuckPuck Wide Range LED Power Module", http://www.leddynamics.com/LuxDrive/datasheets/3021-BuckPuck/pdf, Document COM-DRV-3021-00, Jul. 2005, 8 pages.
Luxen, Application Brief AB05 "Thermal Design Using Luxeon Power Light Sources", http://www.philipsSlumileds.com/pdfs/AB05.pdf, Jun. 2006, 12 pages.
Philips, "Luxeon LED Radiation Patterns:light Distribution Patterns", www.lumileds.com/technology/radiationpatterns.cfm, retrieved Apr. 28, 2007, 1 page.

* cited by examiner

*Primary Examiner* — Thomas M Sember
(74) *Attorney, Agent, or Firm* — McKee, Voorhees & Sease, P.L.C.

(57) ABSTRACT

An apparatus, method, and system for lighting target areas with bollard or pagoda style or type lights in a controlled and efficient manner. The apparatus includes a housing with a light source, optic system, and a control circuit. The light source and optic system are configured to produce a highly controlled output beam pattern and shield from normal viewing angles direct sight of the source. This enables control of glare and spill light which can improve effectiveness, efficiency, and energy usage.

19 Claims, 36 Drawing Sheets

(BOLLARD - TYPE POST 12)

(WALL MOUNT TYPE HOUSING)

(SIDE VIEW BOLLARD - TYPE POST ONLY)

(FRONT VIEW OF FIGURE 4A)

(SIDE VIEW OF WALL MOUNT - HOUSING ONLY)

(FRONT VIEW OF FIGURE 4C)

(FRONT ELEVATION OF FIGURE 5C)

(TOP PLAN OF FIGURE 5C)

(SIDE ELEVATION OF REFERENCE NUMBER 24)

(TOP PLAN VIEW OF CIRCUIT BOARD)

(TOP PLAN)

(SIDE ELEVATION)
(RIGHT SIDE BRACKET)

(TOP PLAN)

(SIDE ELEVATION)
(LEFT SIDE BRACKET)

(TOP EDGE)

(FRONT ELEVATION)

(TOP EDGE VIEW)

(FRONT ELEVATION)

ASSEMBLED

EXPLODED VIEW (SECTION VIEW)

PLAN VIEW

ELEVATION (FRONT)

ELEVATION (SIDE)

APPARATUS AND METHOD FOR PATHWAY OR SIMILAR LIGHTING

CROSS-REFERENCE TO RELATED APPLICATIONS

This application claims priority under 35 U.S.C. §119 of a provisional application U.S. Ser. No. 60/915,158 filed May 1, 2007, which application is hereby incorporated by reference in its entirety.

I. BACKGROUND OF INVENTION

A. Field of Invention

The present invention relates to highly efficient lighting fixtures and methods that provide a light beam pattern suitable for illuminating pathways, walkways, and similar area lighting.

B. Problems in the Art

Many different types of light fixtures exist for the application of lighting pathways. Some of these include bollard, pagoda, or landscaping lights, and the like. These lights use different types of light sources ranging from incandescent to halogen to LEDs (light emitting diodes).

Most of the light sources use lamp wattages in the range of 20 watts or more. The lumen output per watt can be lower than desired, however, often in the range of 10-12 lumens per watt. Thus, the amount of light available on the surface to be lighted is limited unless the lamp wattage is increased, which would increase energy consumption. Therefore, energy efficiency is an issue.

Another problem in this field is that light from the fixture is generally not controlled or is poorly controlled. In other words, substantial light from the fixture does not usefully help light the defined target area. It either falls outside the target or is not useful to illuminate the area. This results in wasted light that does not contribute to the area to be illuminated, as well as creates a potential source of glare and spill light.

A common fixture design for a bollard light or pagoda light comprises a vertical post with the light source mounted near the top and surrounded by a transparent lens. An additional feature may include baffles to help direct the light downward. However, with these fixtures, typically more than 50 percent of the light is wasted as it is directed or travels away from the area to be illuminated. This wasted light not only consumes energy, but distracts from the visual appearance of the target (e.g., pathway) by illuminating areas outside of the target boundaries (e.g., sides of a pathway).

Glare or spill light from light that is poorly controlled is a concern for many lighting designers and viewers. When the light is not controlled or confined to the intended area to be illuminated, the fixture is not efficient. Inefficient fixtures must use higher wattage light sources to provide the required light needed at the target surface. This can increase the amount of glare viewed at the source. Even low wattage sources, such as LED's, can become a potential source of glare if the light source is in the viewer's line of sight. Thus, fixtures that control the light and reduce glare are important for this type application, and many others.

Another concern with many conventional types of these fixtures is maintenance cost. The operating life of the type of light source or lamp used may not be suitable for the application. Lights that operate for 10-12 hours a day will use around 4000 lamp hours per year. Types of lamps with lower lamp life spans will require replacement more often than sources that operate for long periods. For example, a lamp with 10,000 hour rated life will require replacement every 2.5 years, while a lamp with 50,000 hour rated life may not require replacement for 12.5 years. Less maintenance reduces the overall operating cost of the lighting system. However, many typical light fixtures for the above-described applications use lower rated life span lamps and are adapted for those types of lamps.

Therefore, many opportunities exist for improving the current state of lighting for pathways and similar or analogous areas or applications. It is the intention of this invention to solve or improve over such problems and deficiencies in the art.

II. SUMMARY OF THE INVENTION

It is therefore a principle object, feature, advantage, or aspect of the present invention to improve over the state of the art or address problems, issues, or deficiencies in the art.

Further objects, features, advantages, or aspects of the present invention include an apparatus, method, or system which;

a. is highly efficient;

b. effectively controls and directs light output;

c. controls or reduces glare;

d. reduces maintenance needs;

e. is economical;

f. is durable and robust, even in out-of-doors environments;

f. is practical.

These and other objects, features, advantages, or aspects of the present invention will become more apparent with reference to the accompanying specification and claims.

A method according to one aspect of the invention comprises controlling light output in a bollard-type light or a wall mounted fixture for downlighting of an adjacent elongated area to reduce glare and wasted energy.

A method according to one aspect of the present invention comprises controlling the shape of the light output pattern produced by the lighting fixture, as well as the size and direction of the pattern to provide effective lighting at the target location and reduce wasted light.

A method according to another aspect of the present invention comprises reducing glare from the light source by shielding the source from typical viewers when the lighting fixture is installed in operable position.

III. BRIEF SUMMARY OF THE DRAWINGS

IV. DETAILED DESCRIPTION OF EXEMPLARY EMBODIMENTS

A. Overview

Figure 1A:
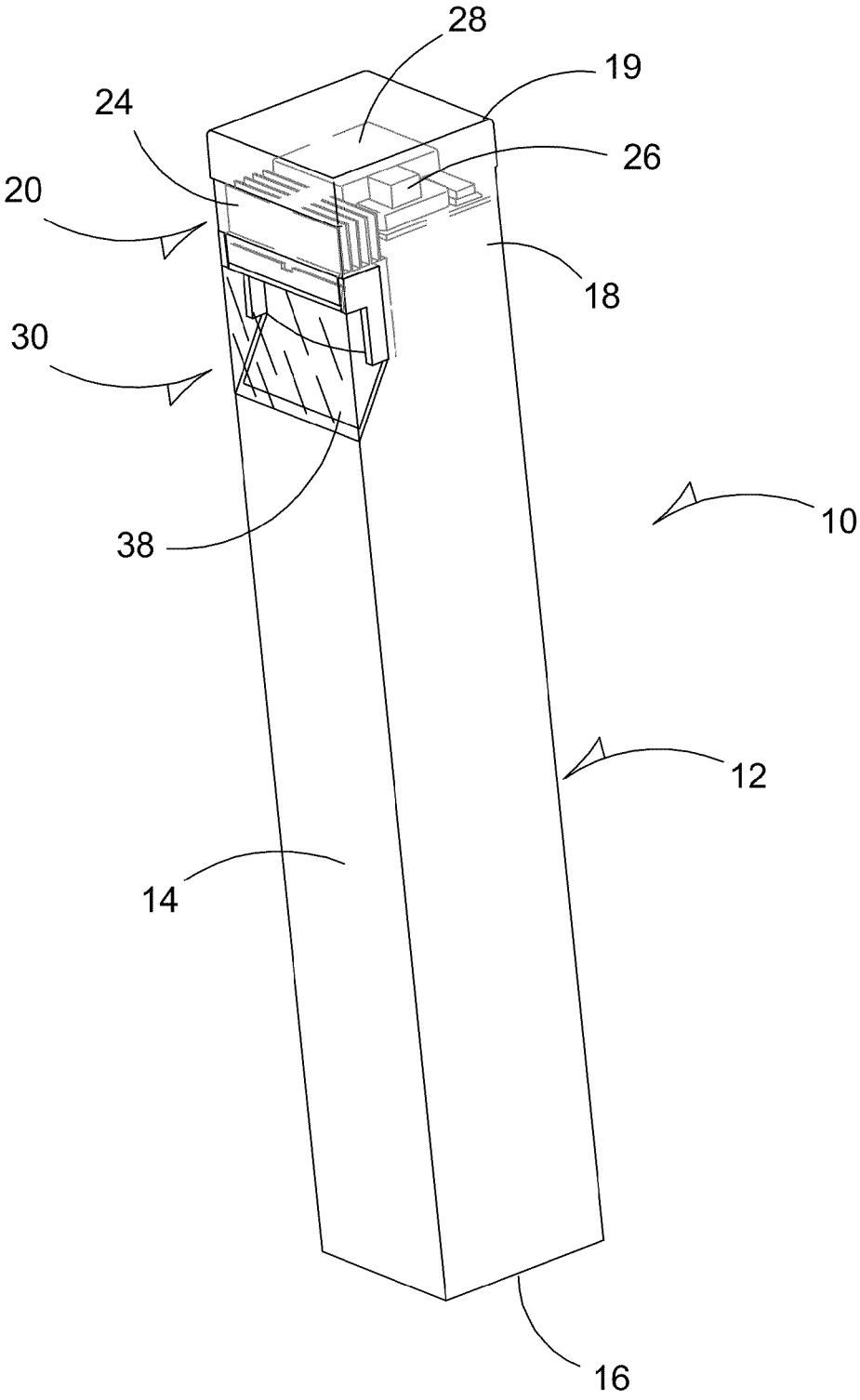
FIG. 1A is a perspective view of an exemplary embodiment according to the present invention.
Figure 1B:
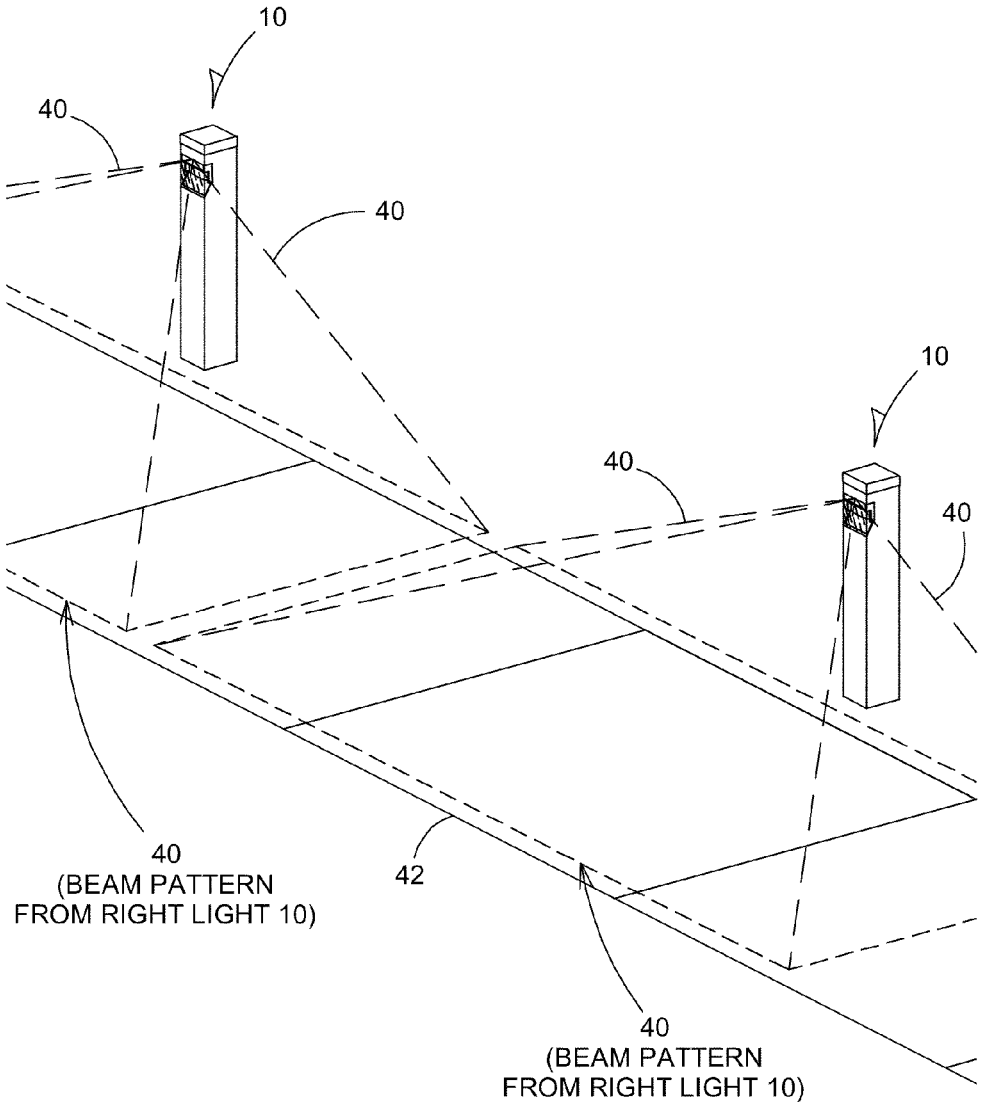
FIG. 1B is a reduced-in-scale perspective diagrammatic view of two pathway lighting devices according to the embodiment of FIG. 1A and their lighting patterns relative a pathway.
Figure 1C:
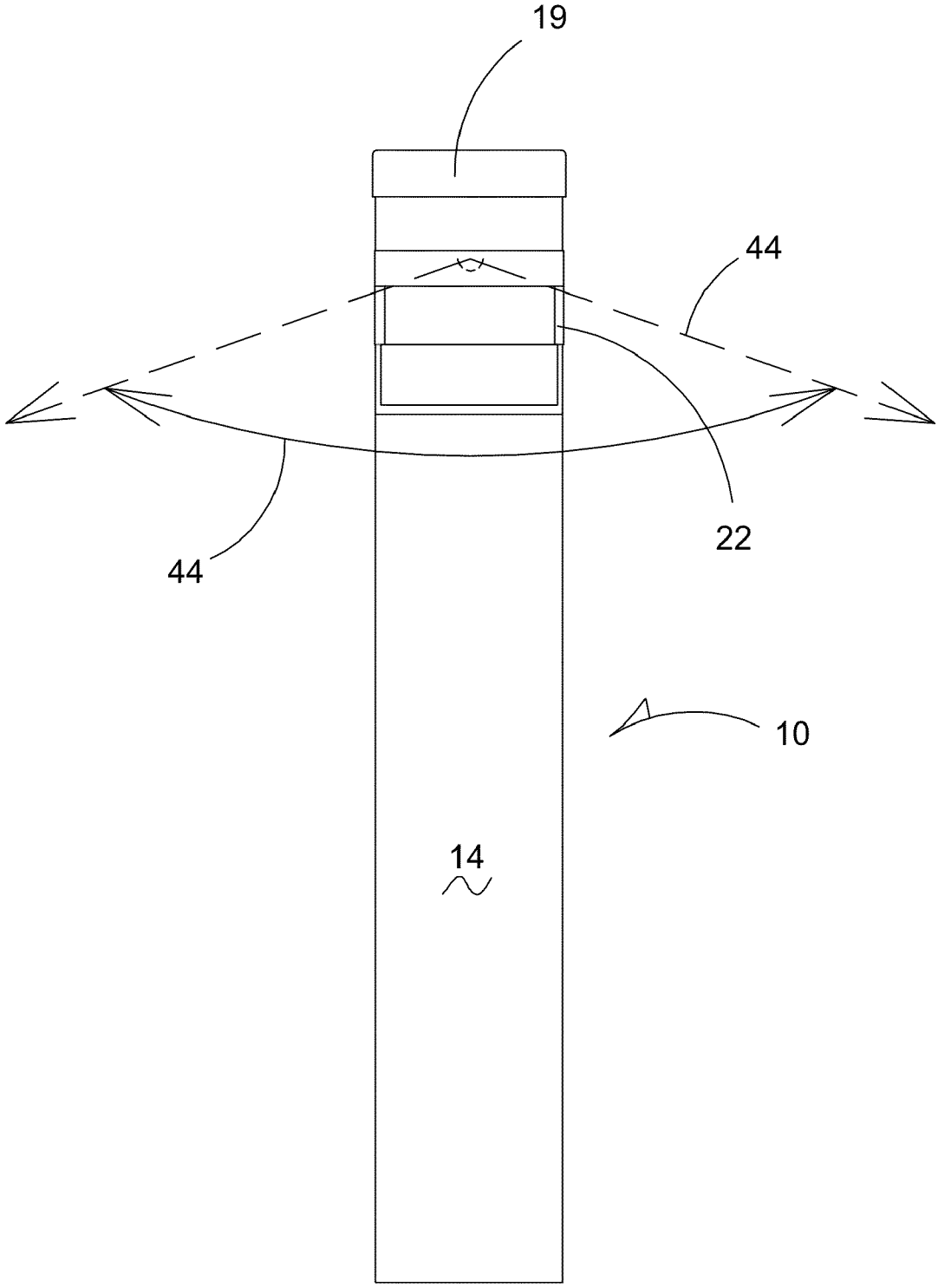
FIG. 1C is a front elevation plan view of FIG. 1A, diagrammatically depicting the light output from the device from that perspective.

To assist in a better understanding of the invention, one example of a form it can take will now be described in detail. It is to be understood that this is but one form the invention could take. A few alternatives and options will also be described. However, the invention could take many forms and embodiments. The scope of the invention is not limited by the few examples given herein. Also, variations and options obvious to those skilled in the art will be included within the scope of the invention.

B. Figures

From time to time in this description, reference will be made to appended figures. Reference numbers or letters will be used to indicate certain parts or locations in the figures. The same reference numbers or letters will indicate the same or similar parts or locations throughout the figures unless otherwise indicated.

C. Conventional Systems

Conventional bollard-type pathway lighting configurations are well-known. For example, a plurality of bollard type fixtures (a light source at or near top of a post or bollard) are installed throughout a landscape (e.g., a park, an estate), generally aside a pathway. These types of fixtures are generally unshielded, with only the lens to protect the viewer from direct view of the light source. In some cases the lens is translucent or almost opaque to reduce the glare and create a muted light. However, this significantly reduces the light available from the fixture. In addition to illuminating the pathway, the area surrounding the bollard is many times also illuminated. While for some landscaped area, this may be desirable, for many others it is not. Some bollard-type lights have some areas around the light source covered or blocked to give some crude control of light.

Another well-known type of light fixture used for landscaping and pathways is commonly referred to as a pagoda light. These types of lights are mounted much closer to the ground surface than a bollard-type light. However, they are similar in how they perform and have the same concerns as bollard-type lights. One reason they are called pagoda lights is the stacked arrangement of cone-shaped plates or baffles that evoke the general appearance of a pagoda. These plates may block some uplight, but only crudely, and tend to give at least some direct line-of-sight to the light source.

The present embodiments of the invention are used for applications similar to conventional bollard or pagoda type systems, but provide efficient and highly-controlled light output that can be directed to substantially only the target area.

D. Exemplary Method and Embodiment 1

According to a first exemplary embodiment of the invention, the method, apparatus and system comprise:

1. A relatively highly efficient light source.
2. An optic system to provide the desired beam size and shape.
3. An electrical circuit to power the light source.
4. A housing and fixture mounting.

The system produces a long and narrow rectangular beam that is suitable for illuminating a pathway. Alternate systems will allow light beam shapes to fit curves in a pathway, intersections of pathways, or areas of interest.

FIGS. 1A-D, 3A, 4A-B, 5A-C, 7A-D, 8A-B, 9A-B, 10A-B, and 11A-E illustrate an apparatus and method according to exemplary embodiment one (designated generally by reference number 10). It comprises a rectangular or square-in-cross-section metal tubular post or bollard 12 with recessed opening or cut-out 50 in the front face and partially in the sides. A commercially-available, solid state light source 22, in this case an LED, is mounted to heat sink 24 and is electrically connected to an electrical circuit board assembly 58.

The circuit board assembly 58 is mounted inside post 12. The tubular post 12 serves as the housing for the light source 22 and its electrical system.

Light source 22 utilized in this embodiment is highly efficient, i.e., has a high lumens per watt ratio, yet is very compact. Such high output LED light sources are an excellent choice due to lumen per watt output in the range of 60 lumens or greater per watt of energy consumed. One example of such an LED is a LUXEON® Emitter model LXHL-DW01 available commercially from Philips Lumileds Light Company, San Jose, Calif. (USA). Details can be found at Technical Data Sheet DS25 (March 2006), available from Philips Lumileds Lighting Company, and incorporated by reference herein. Other LEDs, or even other light sources, may also be used.

The most common color of light output for this application is white, however, other colors are possible and are considered to be included as possibilities. The type of LED used in this embodiment has a side-emitting light output. This type of output helps to provide the long rectangular beam without creating a bright spot directly in front of the fixture. The optic design of fixture 10 utilizes this side-emitting characteristic of the LED to provide the desired shape of the beam without bright spots that create an uneven appearance. A representative spatial radiation pattern for such a side-emitting LED is set forth at Technical Data Sheet DS25, top of page 16. Most of the intensity of the light radiates laterally from the lens of the LED. In this embodiment, LED 22 is mounted lens-down and generally vertically (see FIG. 11C). Therefore, most of the light from the side-emitting model of LED 22 radiates radially outwardly in a generally horizontal plane. As indicated in the radiation pattern of FIG. 11C, the light spreads some, but radiates substantially radially or laterally outwardly in all directions. See also U.S. Pat. No. 6,679,621 incorporated by reference herein, which gives a general illustration at FIGS. 13 and 14 of a side-emitter LED radiation pattern (through a vertical cross-section of the LED and its lens).

In exemplary embodiment one, source 22 is side-emitting. It is to be understood that other radiation patterns could be used. Not only side-emitting patterns, but also what are known in the art as "bat wing" and Lambertian patterns could be used. If a Lambertian pattern is used, the high concentration of light near the center would cause more light to be present near the fixture and less light at the outer edge of the beam. Graphs of the bat-wing and Lambertian patterns can be seen at www.lumileds.com/technology/radiationpatterns.cfm, incorporated by reference herein.

The optic system 20 of the exemplary embodiment one captures incident light from source 22 and directs it to the target area (e.g., pathway or sidewalk 42 to be illuminated). For pathway lighting, a relatively long and narrow light beam is beneficial to reduce the amount of wasted light that spills off the intended area. This wasted light often illuminates unwanted area and distracts from the main areas of interest. In other words, it is generally desirable that the beam follow the general shape of the pathway.

Optic system 20 uses some surfaces of highly reflective material to direct some of the light from the fixture 10. The optics 20 control the light in the forward direction, prevent light from traveling in the reverse direction, i.e., behind the pole 12, and project light laterally out the sides to create a beam that is longer laterally (in opposite directions from and parallel to the front of bollard 12) than its width (straight out from the front of the bollard 12). To project the light to opposite sides, a curved reflective surface 36 is used to direct the light in the intended direction. By referring to the Figures, it can be seen how the relatively compact light source 22 output pattern can be spread laterally in opposite directions in front of the bollard primarily by curved reflective surface 36. For example, the lateral horizontal beam spread 44 is controlled (see FIG. 1C), as well as vertical beam spread 46 (see FIG. 1D)

It is to be understood that selection of the particular shape and reflective characteristics of surface 36 can vary according to need and desire. The beam can be made longer, shorter, wider, or thinner. Alternative reflective material can be used to alter the beam size and shape. For example, a semi-specular material or peened pattern can be used to create a wider beam as these types of materials tend to diffuse the light. The shape of the beam can be altered by changing the position of the reflective material. More on these alternates will be discussed in the Alternative and Options Section. The precise shape and nature of the output light pattern from fixture 10 can be varied according to need or desire by empirical methods and the skill of those skilled in the art.

As shown in the Figures, and as diagrammatically illustrated in FIGS. 11A-E, the light source 22 and optics 20 are defined substantially by a box-shape surrounding light source 22. The box shape has an open bottom. The convex curved surface 36 forms the back wall of the box-shape and extends substantially lower than the light source 22. This accomplishes several things. One is that the light source 22 is basically hidden from direct view by normal viewing angles. This reduces glare into the eyes of viewers or passersby. Another is that the box or enclosure blocks much light that otherwise might tend to travel outside the intended controlled pattern. Another is that the limited radiation pattern of the side-emitter LED 22 is substantially contained in the box, but the placement and selection of certain highly reflective surfaces inside the box intercept and redirect much of the light onto convex surface 36, or intercepts and redirects light directly from source 22, which tends to evenly spread the light in the rectangular pattern that not only lights the area directly in front of the bollard 12, but substantially in opposite lateral directions. In this manner, light is controlled to place most of it only on the pathway, but also have a somewhat even illumination for a substantial distance both left and right of fixture 10 (see FIG. 1B). It is emphasized that the light output pattern does not have a very high intensity or "hot spot", but is more evenly distributed. This allows relatively wide spacing of the next light fixture 10 and so on. Less lights 10 are needed to light the whole pathway. Additionally, less light is wasted by spilling off the target, the pathway, which is a more efficient use of light. Also, less spill light means there is higher contrast between the lighted path 42 and the non-lighted areas outside path 42. In at least some circumstances, this greater contrast allows less light to be used to light path 42, which would create even more efficiency. At a minimum, fixture(s) 10 are more efficient individually, but also cumulatively, because they better control light substantially to only the path 42.

Figure 3A:
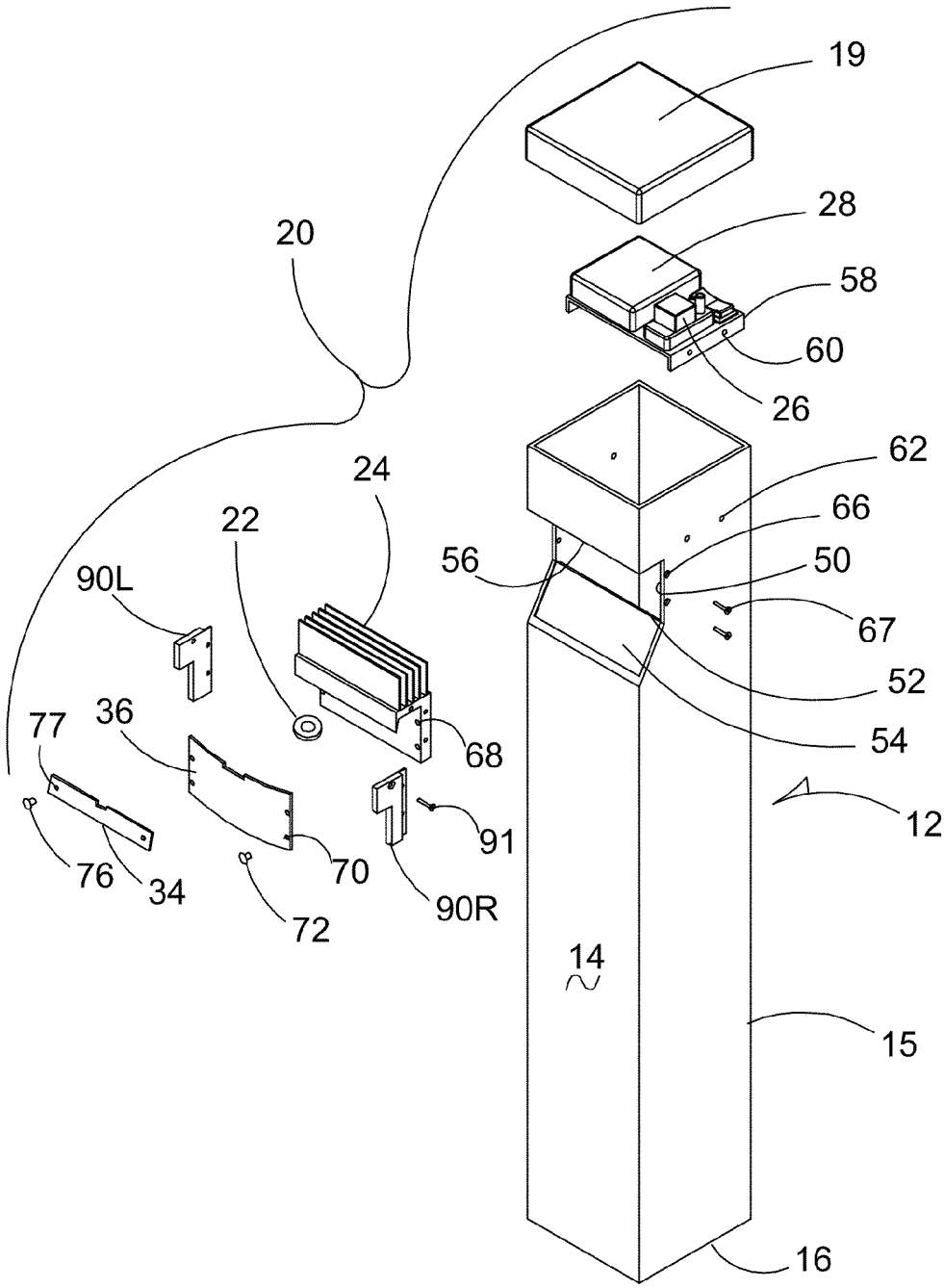
FIG. 3A is an exploded view of FIG. 1A.
Figure 5A:
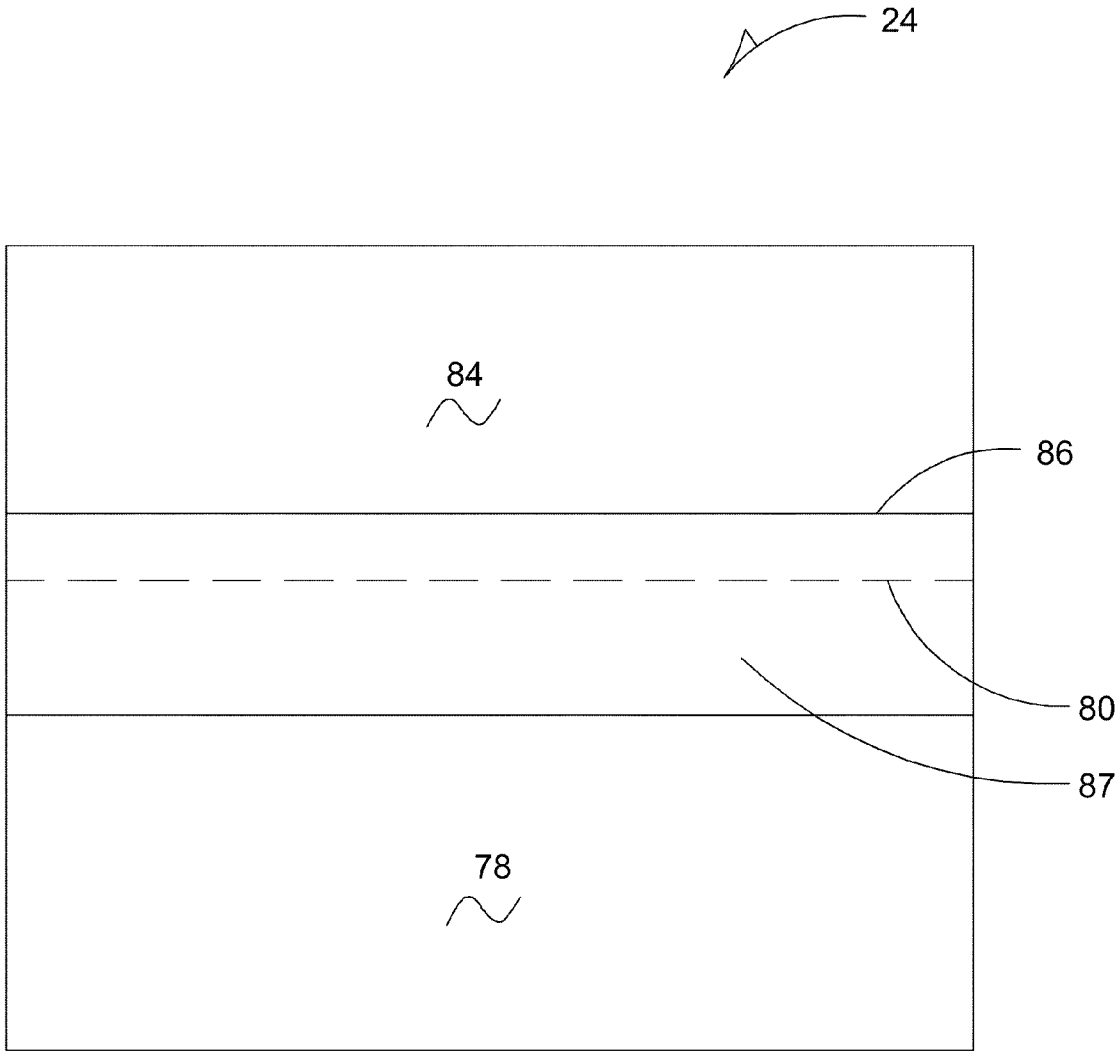
FIG. 5A is an enlarged front elevation plan view of an interior mounting member and heat sink for a light source and reflective surfaces from FIG. 3A.
Figure 5B:
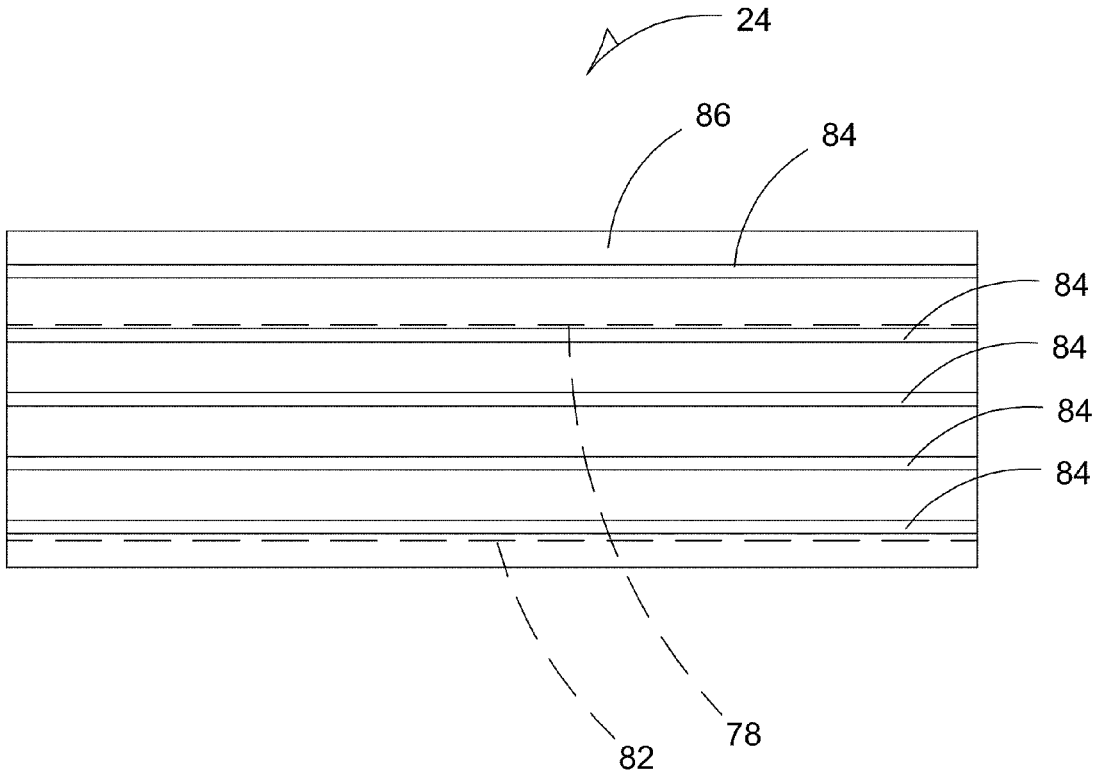
FIG. 5B is a top plan view of FIG. 5A.
Figure 5C:
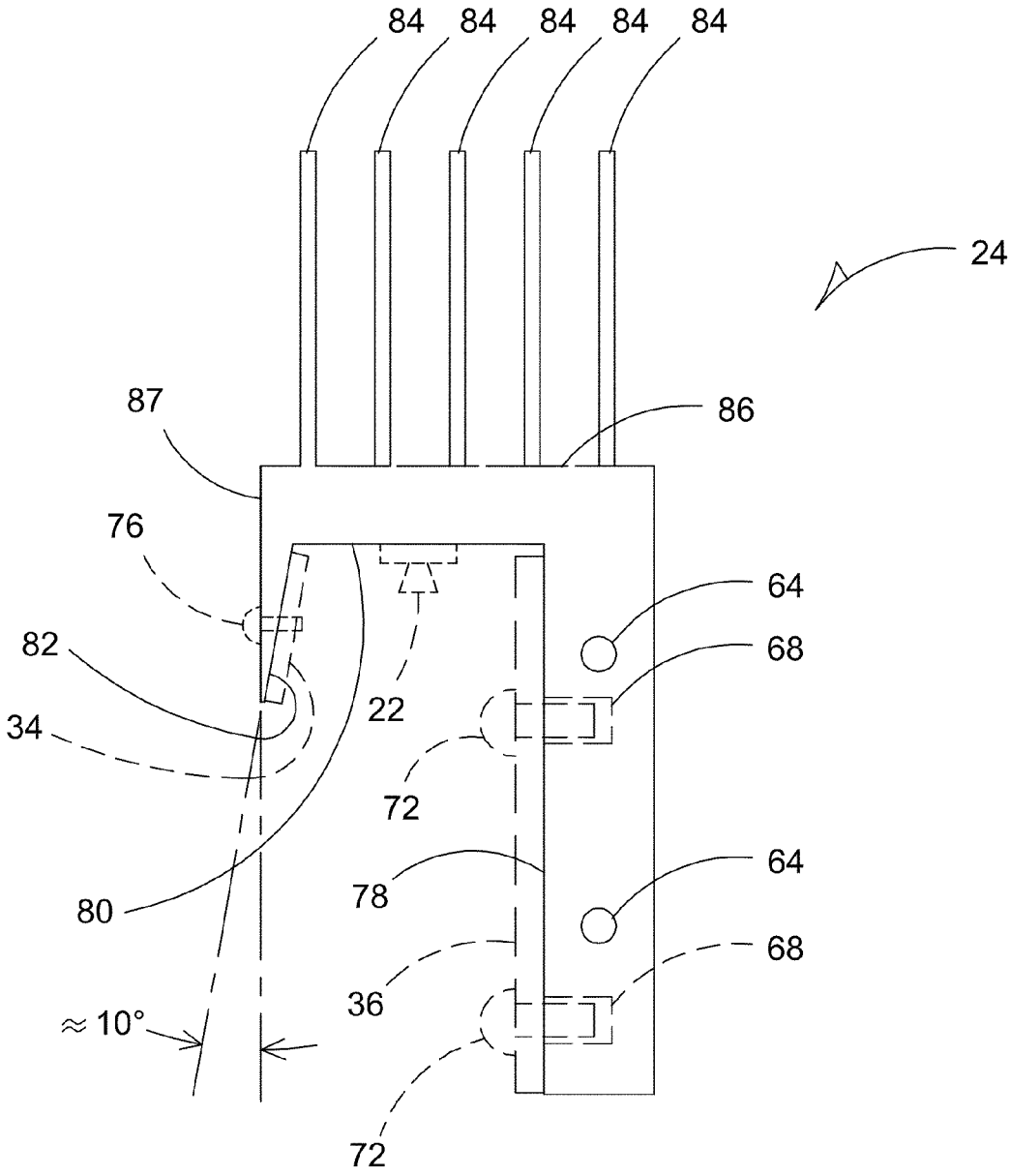
FIG. 5C is a side elevation view of FIG. 5A.
Figure 6:
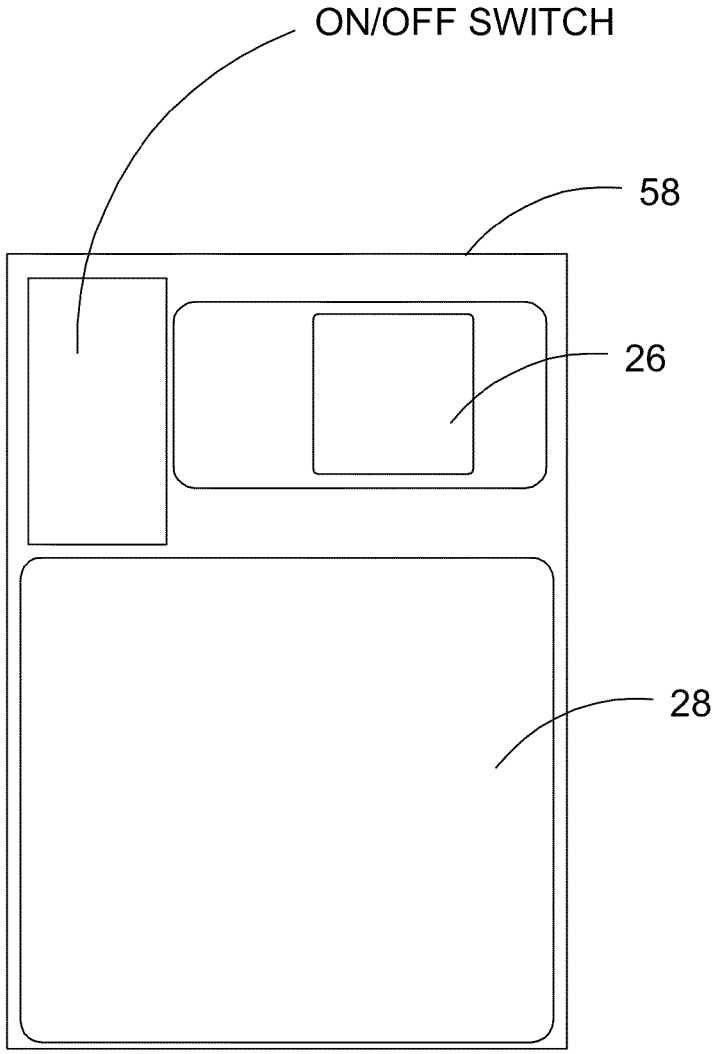
FIG. 6 is a top plan view of a circuit board and components from FIG. 3A.
Figure 7B:
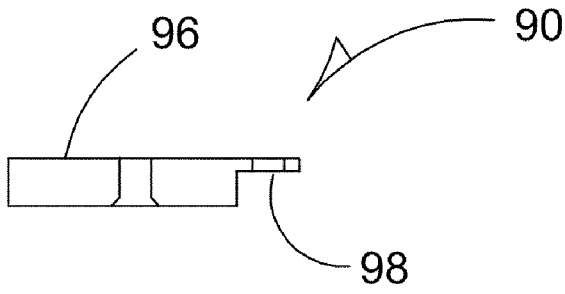
FIGS. 7A and 7B are side plan and top plan view respectively of a side light controlling piece from FIG. 3A.
Figure 7A:
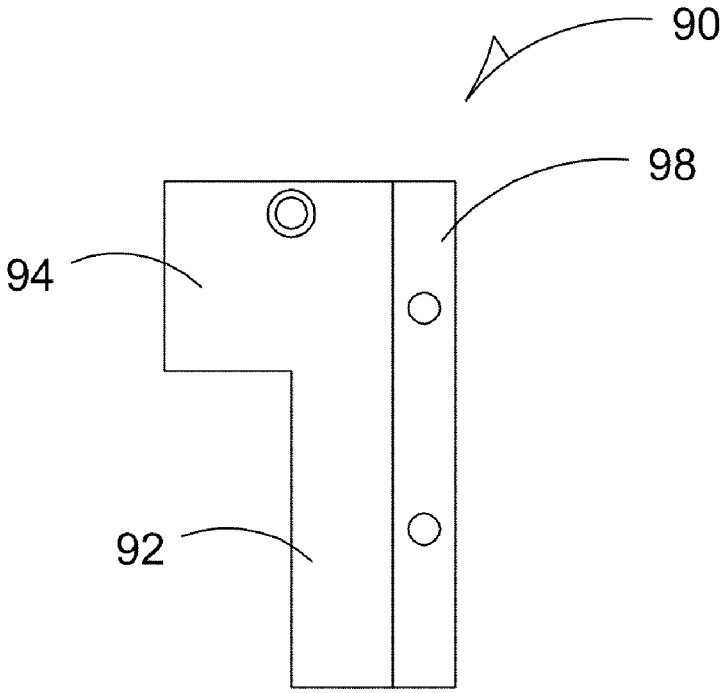
Figure 7D:
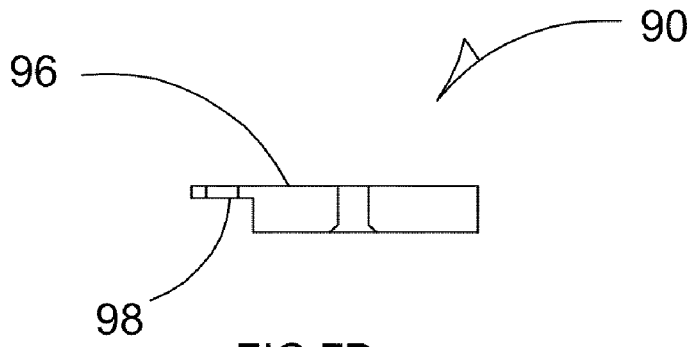
FIGS. 7C and 7D are side and top plan views respectively of the opposite side light controlling member of FIG. 3A.
Figure 7C:
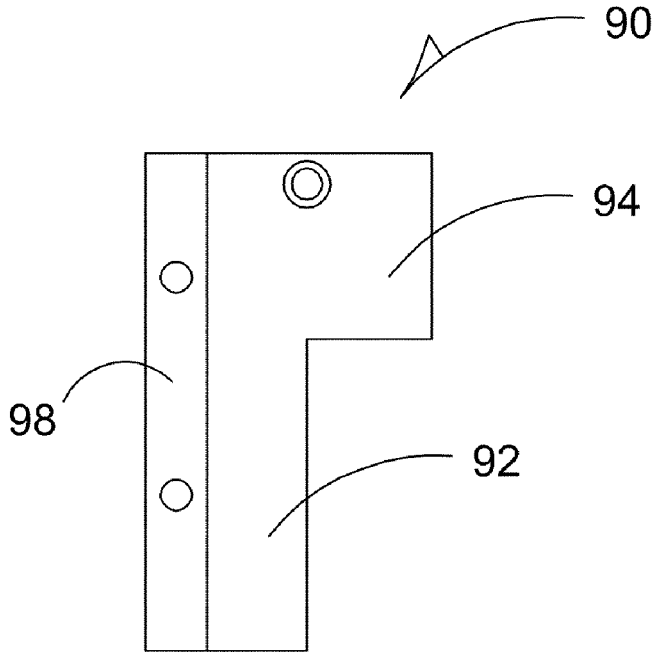
Figure 8B:
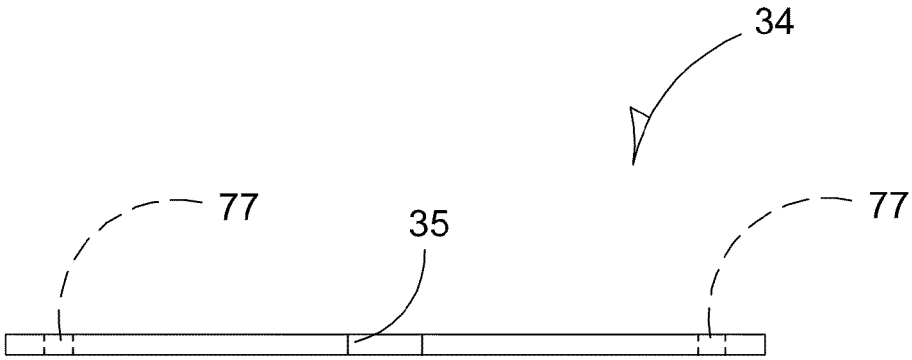
FIGS. 8A and 8B are front and top edge plan views respectively of a reflective member from FIG. 3A.
Figure 8A:
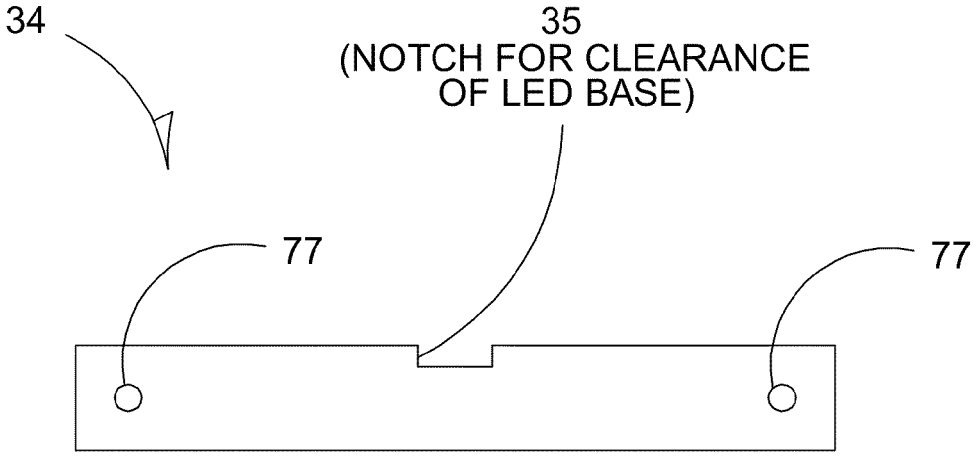
Figure 9B:
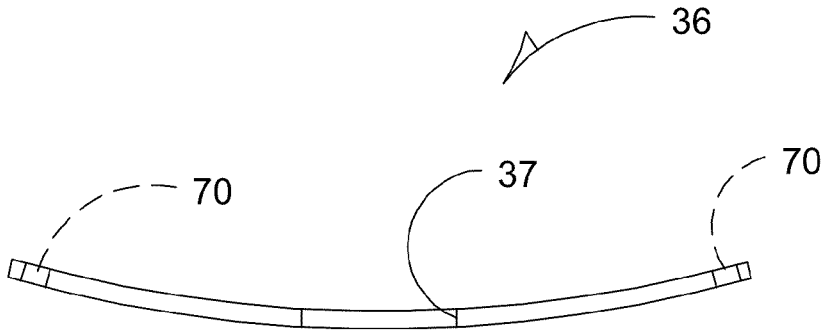
FIGS. 9A and 9B are front and top edge plan views respectively of a second reflective member from FIG. 3A.
Figure 9A:
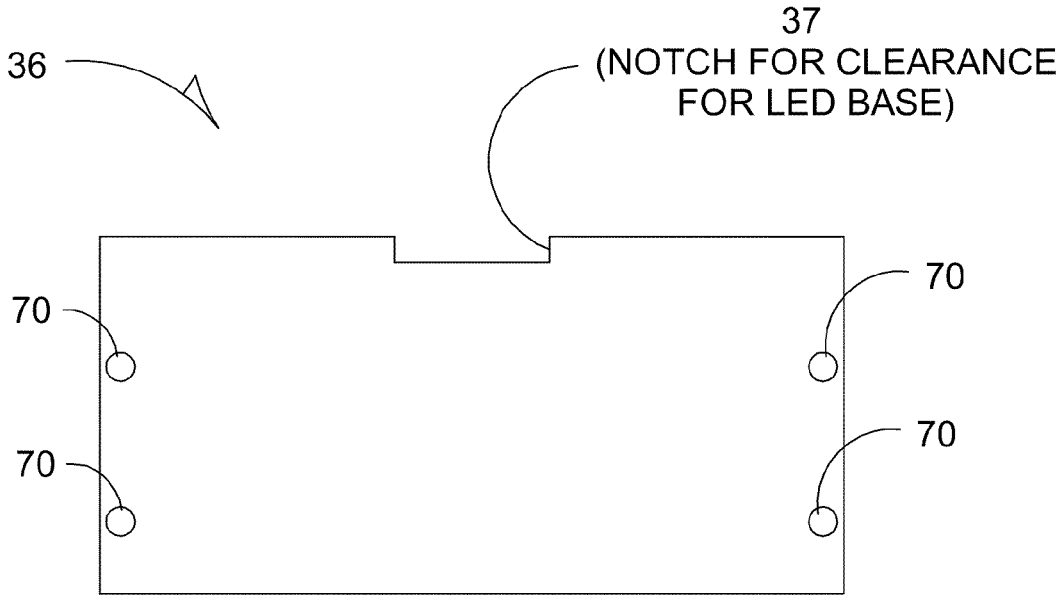
Figure 10A:
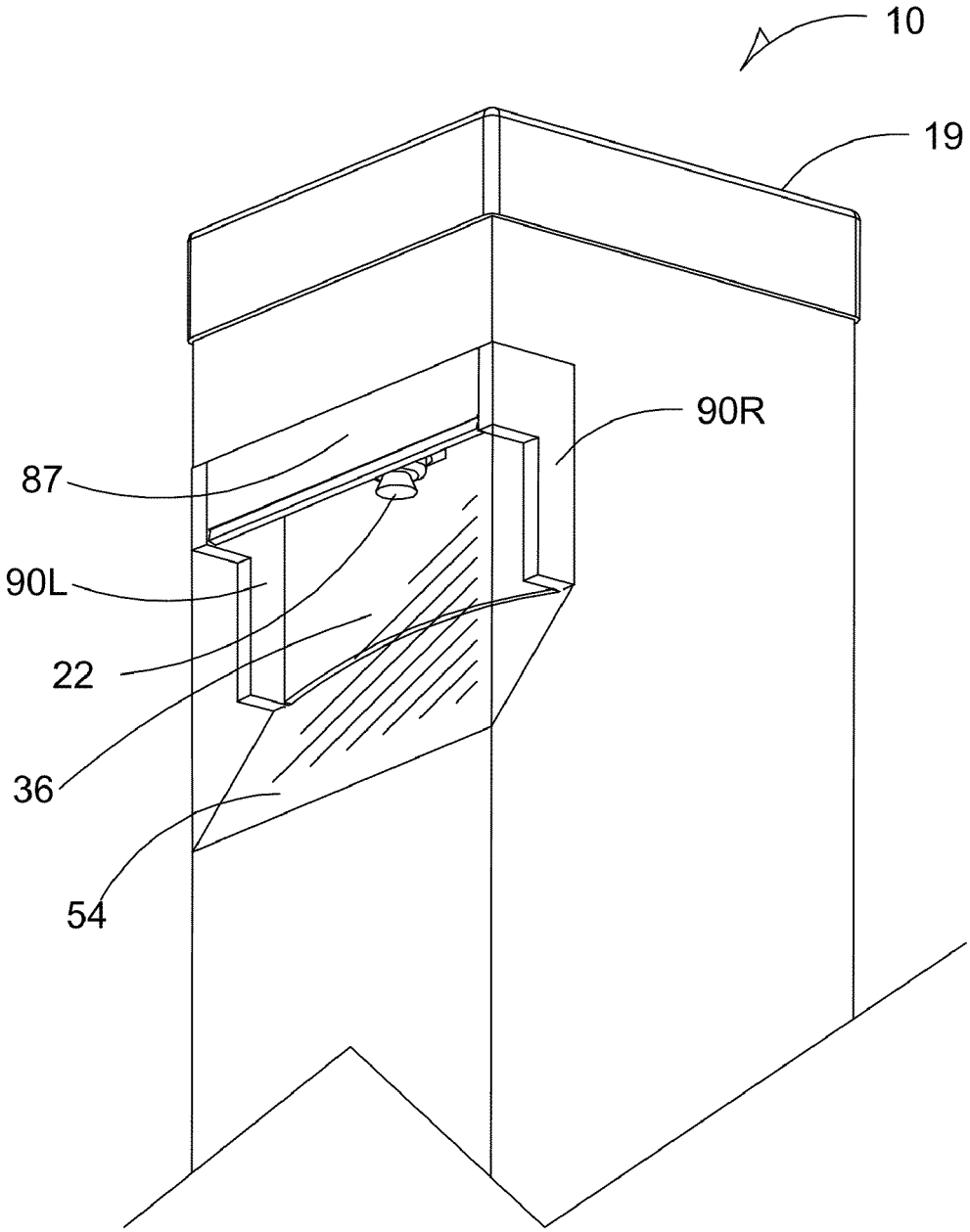
FIG. 10A is an enlarged detailed view of the device of FIG. 1A.
Figure 10B:
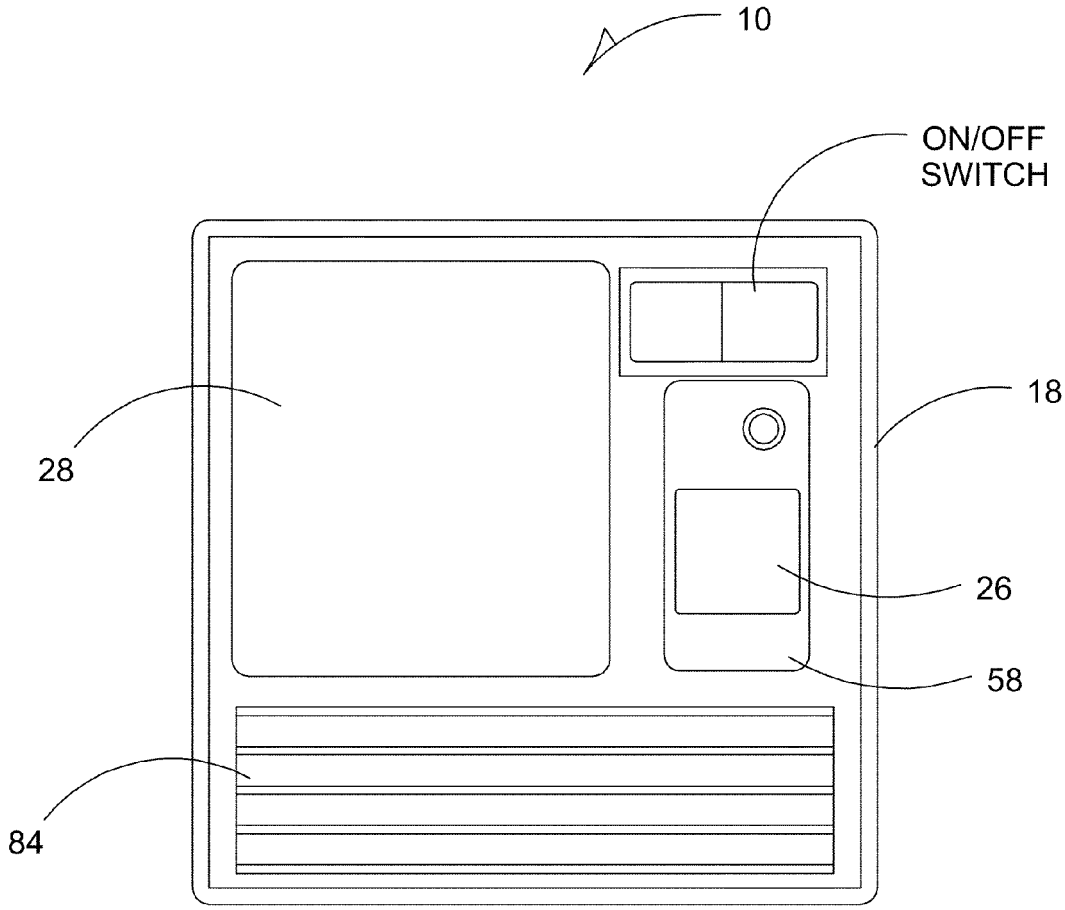
FIG. 10B is an enlarged plan view of circuit board 18 for fixture 10.
Figure 11A:
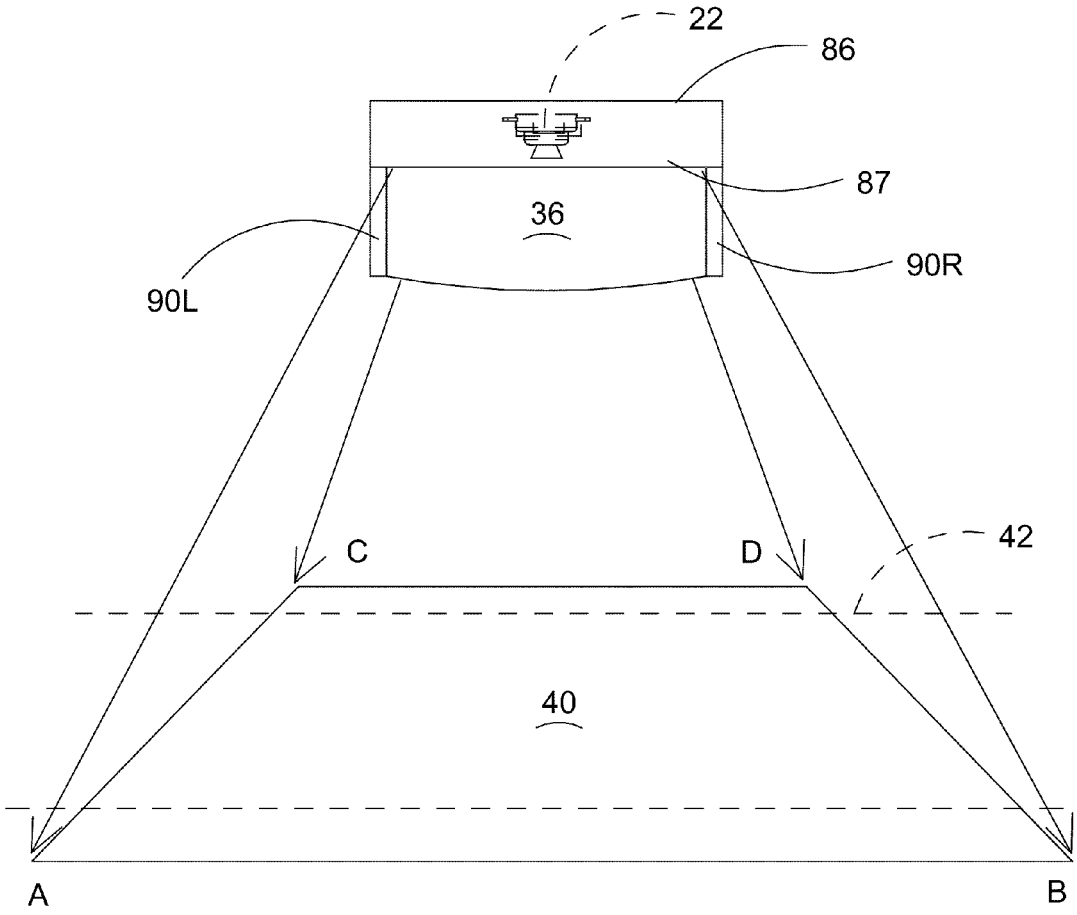
FIG. 11A is an isolated diagrammatic view of the light output pattern from the device of FIG. 1A.
Figure 11B:
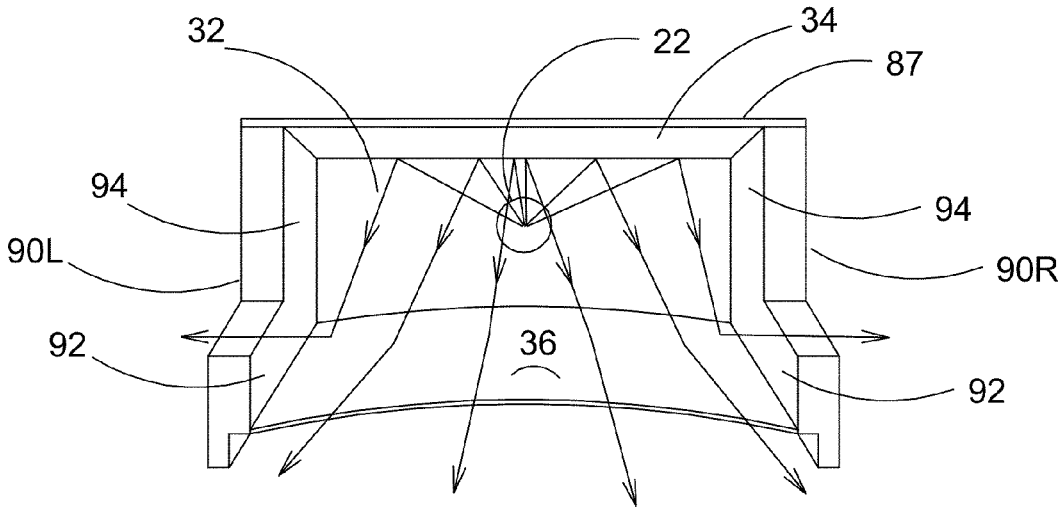
FIG. 11B is an enlarged diagrammatic view from a different perspective of the light output pattern of FIG. 11A.
Figure 11C:
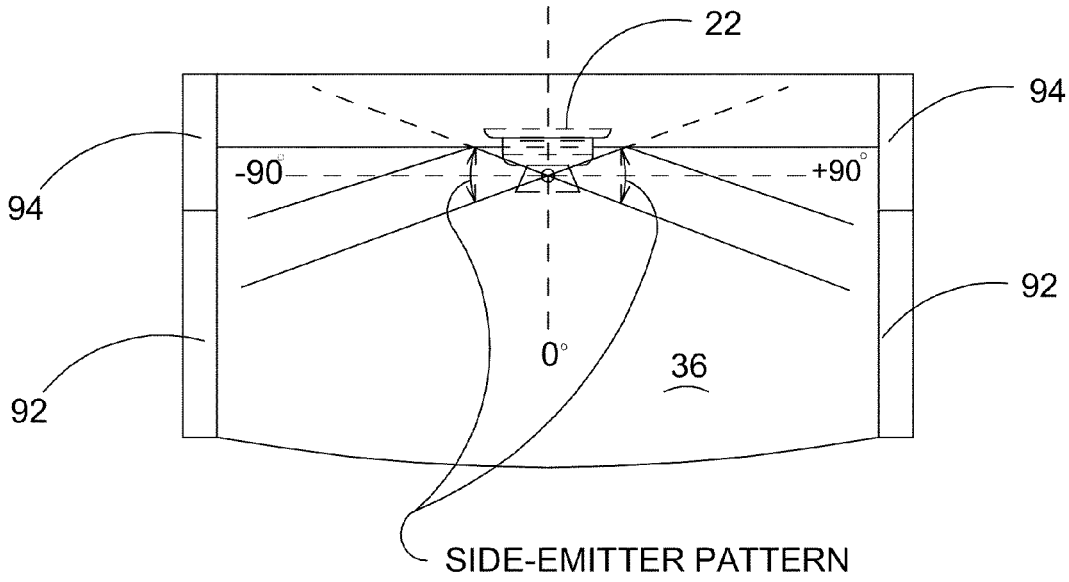
FIG. 11C is a partial sectional and diagrammatic view from a different perspective of the light output pattern of FIG. 11A.
Figure 11D:
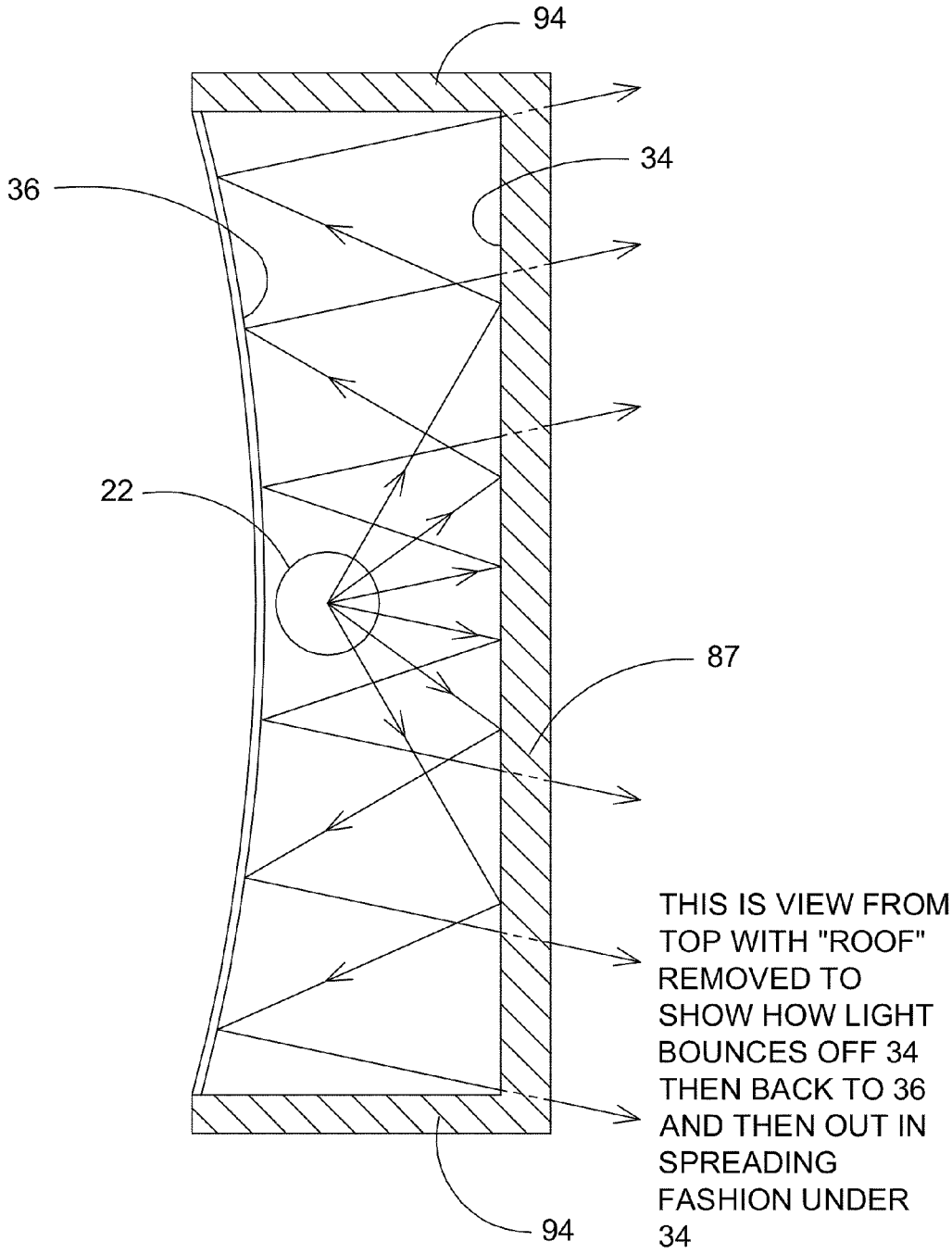
FIG. 11D is a still further diagrammatic view of the light output pattern of FIG. 11A.
Figure 11E:
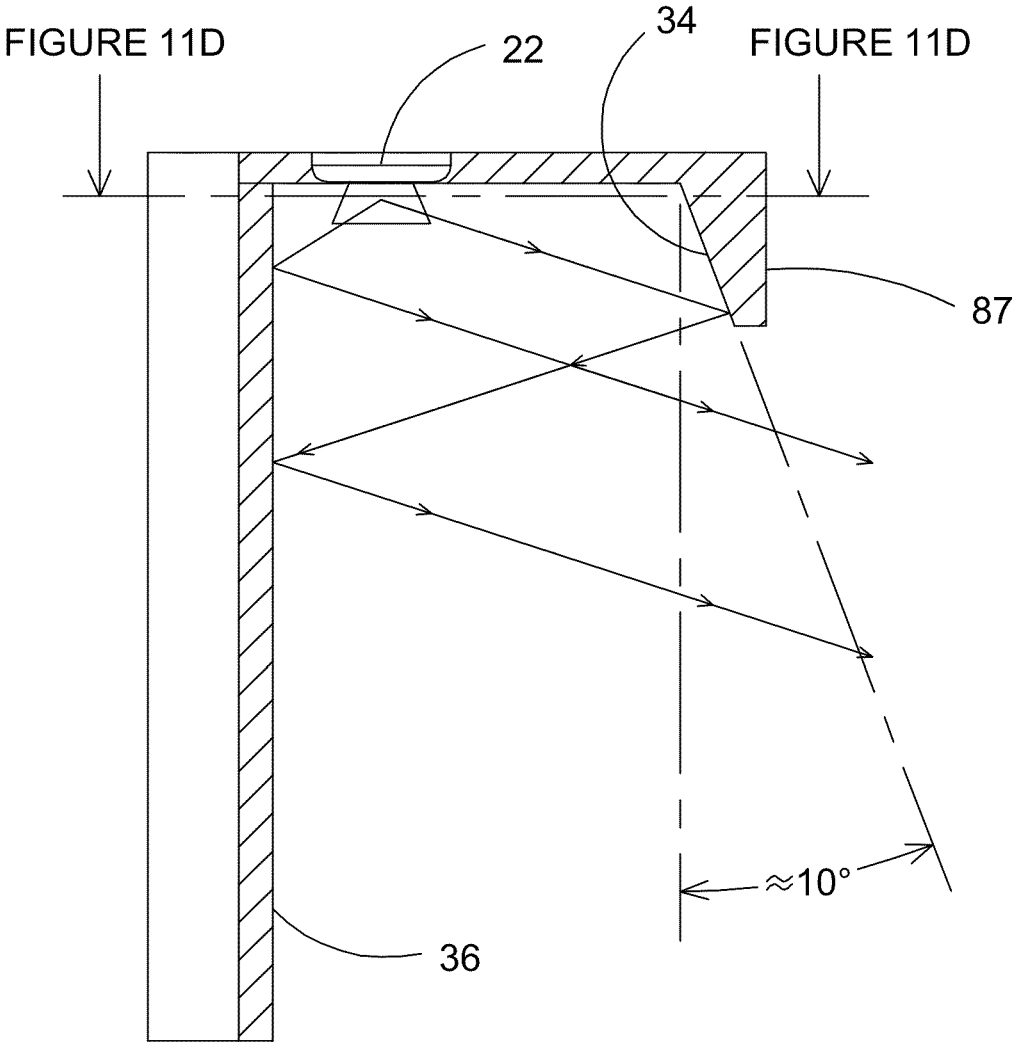
FIG. 11E is a partial sectional view of the light output pattern of FIG. 11A.

As can be seen, the optics 20 are basically installed on or integrated with, the heat sink 24 (see, e.g., FIGS. 3A and 5C). This optical sub-housing 24 provides the thermal management method required for the LED light source as well as mounting geometry for source 22 and surfaces 34 and 36. Considerations for thermal management of LED sources is set forth in Application Brief AB05, entitled "Therman Design Using Luxeon® Power Light Sources" (June 2006) available from Philips Lumileds Lighting Company and incorporated by reference herein. In the exemplary embodiment one, a heat sink can be essentially integral to the sub-housing 24, which also provides the mount for the LED 22.

There is no requirement to have the reflecting surfaces on the heat sink, but this is a convenient way of mounting the reflective surfaces relatively close around the light source.

To power the light source, an electrical system is required. The electrical system includes DC power with a constant current driver to provide the required power to the LED. Document COM-DRV-3021-00, (July 2005), rev. 2.3, available from Lux Drive, a division of LEDynamics, Inc. of Randolph, Vt. (USA), entitled "3021/3023 Buck Puck Wide Range LED Power Module", which is incorporated by reference herein gives details regarding an example of such driving circuitry (e.g., LUXDRIVE™ LED power module model 3021/3023 BuckPuck™ from LuxDrive). The electrical system can include a dimmer to vary the light output, include sensors to detect when light may be required, be remotely controlled by control system, or even be networked together to provide control for an entire region of lights. The DC power source can be from a central DC source, provided from battery power, solar power, or converted from AC to DC at each location.

The post or bollard 12 can be constructed of different materials with a protective finish. The exemplary embodiment utilizes extruded aluminum tubing with a durable powder-coated finish (in any of a number of varying colors). Painted steel, galvanized steel, or stainless steel materials could also be used. Other types of posts can also be used. The tubular post can be square, rectangular or circular, or other shapes. Cast metal can be used to create a decorative post with ornate details. To secure the post 12, a mounting plate (not shown) can be attached (e.g., welded or by other means or methods) to the bottom of the post 12. The post 12, with base or mounting plate, can be anchored to a concrete foundation or to a pathway. Alternately, post 12 can be extended and have its lower end buried into the earth. Other mounting methods are, of course, possible.

1. Details of Embodiment 1

FIGS. 1A-D illustrate the basic embodiment one utilizing a tubular post 12 with an LED light source 22 to produce light suitable for illuminating a pathway 42. The tubular post 12 serves as the mounting and protective housing for light source 22 and its related systems (optic system 20 and electrical circuit assembly 58—see FIG. 3A). Transparent lens cover 38 protects LED 22 and optics 20 from damage and exposure to dirt; which can decrease efficiency. Each component within the embodiment will now be discussed in greater detail. Post 12 here is approximately 4 inches by 4 inches in cross section and 24-36 inches tall.

Tubular post 12 is constructed of corrosion resistant, extruded aluminum with protective powder coat finish available with a color or colors to suit the installed environment. Notch 50 (FIG. 3A) near the open top 18 of post 12 is cut into face 14 and sides of tubular post 12 for the light 22 and optical system 20 mounting (see bottom edge of section 56, and exposed sides in FIG. 3A). A sealed cover 19 is installed over the top of the tubular post to keep electrical components dry. Post cover 19 can be constructed of many different materials, for example, including but not limited to composites, cast metals, and a formed plate. This removable arrangement allows easy access to the electrical circuit and optic system from the top of apparatus 10. O-rings, gaskets or other sealing methods (not shown) can be used to help form a seal between post and cover. An alternative embodiment of post 12 may not have a separate cap 19, but have a closed top end.

Figure 1D:
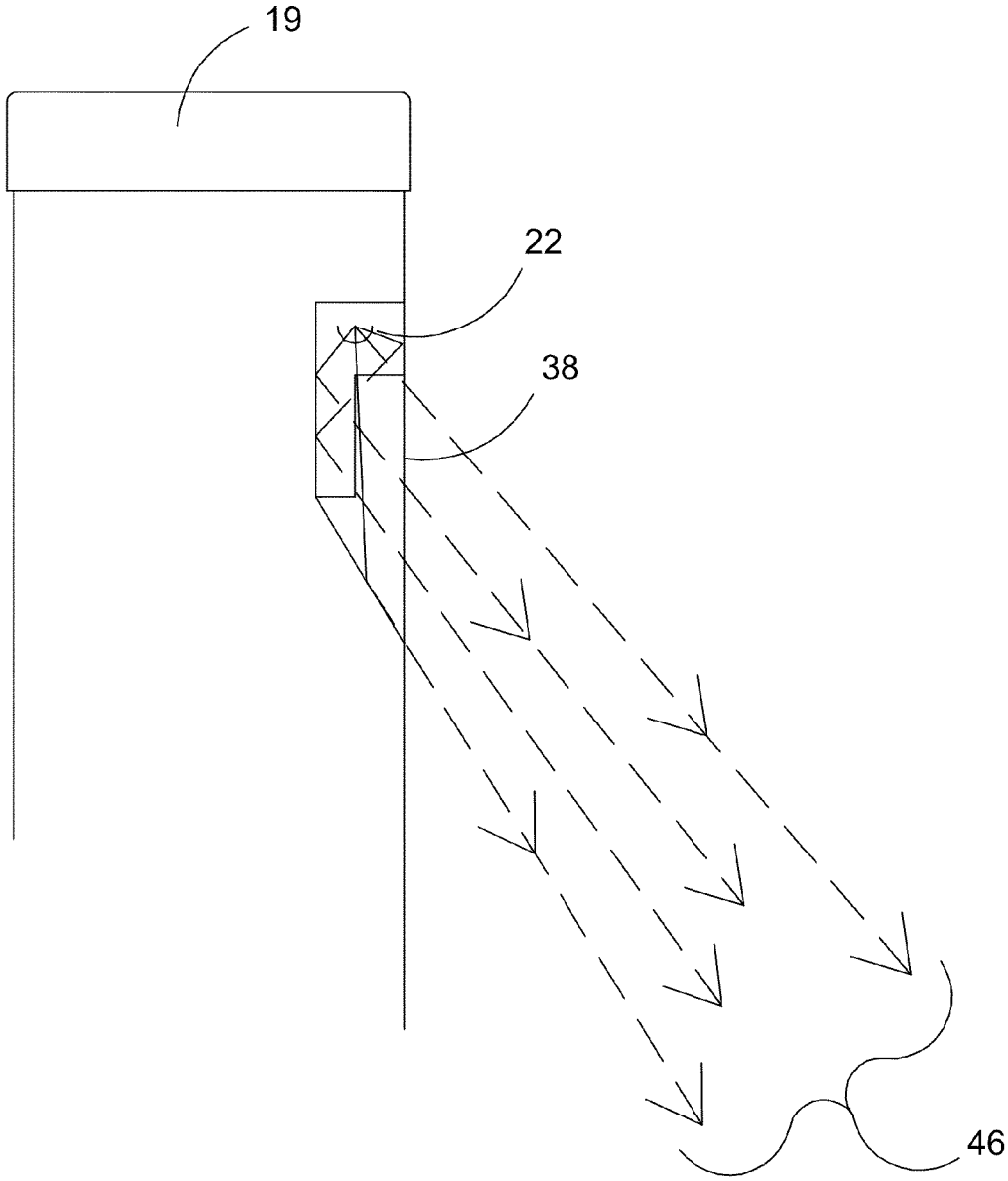
FIG. 1D is an enlarged side elevation view of FIG. 1A showing diagrammatically the light output pattern from that perspective.

Sloped face 54 extends up to top edge 52 (FIG. 3A) of the cut notch 50 can be of similar material as the post and can be welded in place or similarly affixed to become an integral part of the post. The notch 50 in the post 12 allows the light beam to extend outwardly in front of post 12 as well as laterally in opposite directions of post 12 (see FIG. 1B). See also FIG. 1C, which is intended to generally illustrate how fixture 10 spreads the light from it in opposite lateral directions in front of post 12 (but limits the outer opposite edges of the beam in those lateral directions). This creates the long, lateral length 44 of the beam but does not allow substantial light above a horizontal plane through the light source; and also has quite well-defined edges. FIG. 1D is intended to generally illustrate how fixture 10 also creates the width 46 of the light beam along its length (but limits the beam's spread and opposite edges along its length). This creates the narrow width of the beam compared to its substantially longer length. One example of beam dimensions along a pathway would be thirty feet long (15 feet laterally on each side of post 12) and a plurality of feet wide (e.g., 3 or 4 feet forward of post 12). Of course, these dimensions can vary according to need or desire of the designer.

The perspective and isometric views of the exterior of light 10 in the Figures give an idea of what light 10 looks like from multiple directions. Note how it has a clean exterior appearance. It appears as a rectangular or square post. Note how fixture 10 builds inside the perimeter dimensions of the post the light source, optics, and electric circuitry to generate a rectangular beam pattern to just one side of post 12.

The optical assembly 20 for light source 22 is constructed using an extruded aluminum shape with integral heat sink 24 to conduct heat away from the light source 22. The optical housing heat sink 24 includes two L-shaped end plates 90 L and R connected to the extruded shape 24 via fasteners 91 (see FIG. 3A—only one is shown for illustrative purposes) or other suitable means. The optical housing assembly 24 is then affixed to post 12 using rivets 67 or other suitable fasteners through mounting holes 66 in housing 12 into threaded holes 64 of component 24. The optical housing 24 also provides a mounting means for the reflective strips 34 (fasteners 76 and holes 77) and 36 (e.g., holes 68 and rivets or screws 72) that control and direct the light to the target area 42.

In this embodiment, strips 34 and 36 have reflective surfaces made of very high reflectivity material. An example would be high reflectivity material under the brand name Anolux Miro® IV anodized lighting sheet material (Anomet, Inc. of Brampton, Ontario, CANADA) (high total reflectance of at least 95%). An alternative is silver-coated aluminum (from Alanod Aluminum of Emnetepal, GERMANY) (e.g., on the order of 98% or so total reflectance). The silver-coated material may have a greater reflectivity (on the order of 98%) but may not be as durable as the former-mentioned material. Other materials would be possible. Thus, even though there is some loss of light when reflected, and in this embodiment most of the intensity in the beam 40 is from light reflected at least once (and sometimes two or more times), the high reflectivity surfaces minimize light loss due to reflection and thus promote high efficiency.

It should be noted that it is recommended that a protective release sheet be maintained over these highly reflective surfaces until just prior to final assembly to minimize potential of adherence of (and lumen depreciation caused by) oils, dust, or other debris (which can affect reflectivity) from handling by workers or from other sources.

It should also be noted that some of the light from source 22 will not strike highly reflective surfaces. For example, as illustrated in FIGS. 11A-E, some light will strike pieces 90 or sloped surface 54. In the exemplary embodiments, these surfaces are not highly reflective. They can be painted, for example. Therefore, there may be some light loss because of light absorption or lack of controlled reflection or reflectivity. However, these surfaces are not non-reflective. Therefore, some fraction of light may reflect and contribute to beam 42. For example, sloped surface may assist in directing some light down directly in front of post 14 even though it is not highly reflective.

FIG. 3A shows strips 34 and 36 exploded from fixture 10. FIG. 5C shows where they are mounted for operation. Each is attached directly (by machine screws or other suitable fasteners or methods) to a surface of heat sink 24. What will be called front inside reflector strip 34 is mounted to the inner-facing surface 82 of front, downwardly extending wall 87 of heat sink 24. Strip 34 faces towards light source 22. Note how the inner side of wall 87 of the extruded optical housing is slightly tilted (e.g., 10 degrees) relative light source 22 to throw incident light back towards but somewhat downwardly to the curved reflective strip 36 along the back wall 78 of the optical assembly. In this embodiment, this tilt is created by tapering wall 87 from thicker at the top to thinner at its lower edge. Heat sink fins 84 extend from surface 86 of component 24.

The back reflective strip 36 is affixed to the optical housing using rivets 72 or similar fasteners. It is convex relative to a horizontal plane to project more of the light toward the sides of the beam 40 and less directly in front of post 12. This approach works with the side emitting LED to produce a uniform rectangular light beam pattern 40. To even the beam pattern's intensity, more light needs to be directed to its farther points relative the center of the elongated pattern.

A transparent lens cover 38 (FIG. 1A) is installed on the post 12 to cover the notched area 50 of the support post 12 and the optical housing. The lens cover 38 can be constructed of glass, high clarity acrylic or other suitable transparent material. Lens material preferable should be constructed of UV resistant material or contain a UV resistant coating for out-of-doors applications. It could be made of translucent material, but this would decrease the amount or control of light.

The electrical system provides the required power and circuitry to drive LED light source 22. The input power is 0-24 volts DC. The electronic circuit to power the LED source includes a constant current driver 26, such as BuckPuck Model 3021 from LuxDrive of Vermont, USA. These are commercially available. Details can be found in Document COM-DRV-3021-00, previously incorporated by reference.

The DC input power for the LED 22 can be achieved by various means. Typical 120V AC house power can be converted to DC using a centrally located AC to DC transformer of the appropriate size with DC power routed to the pathway lights 10. Alternately, an AC to DC transformer or converter could be included in the electrical system at each of the pathway light 10 locations. This will allow routing 120V AC power to each light source 22 if desired. Another option would be to power the light 10 using a rechargeable DC power source with photovoltaic recharging system (not shown) mounted at each of the post locations, or a centrally located, larger photovoltaic system for plural lights 10. A solar power system and DC battery storage would need to be sized to provide power for the duration of time that the lights will be operated, allowing for some reserve power in case of days with reduced sunlight to allow the system to become fully recharged.

Light 10 could be configured in a portable mode. An option suitable for a portable system is to use small DC alkaline batteries 28 such as four AA batteries. In such a system, an on/off switch (see FIG. 10B) could be provided to manually turn the lights on. A dimmer switch (not shown) could also be installed at each location.

The electrical system of embodiment one comprises commercially available components and is easily constructed by those familiar with LEDs and the electronics field. The electrical circuit board or plate 58 is installed inside the tubular post housing (see FIG. 3A) (e.g., with fasteners [not shown] into aligned holes 62 and 60).

The Figures illustrate how fixture 10 is constructed, and the configuration of its parts. FIGS. 11A-E, in the context of the other Figures and description, are intended to roughly diagrammatically illustrate how fixture 10 generates rectangular beam pattern 40. First, side-emitting single LED source 22 is mounted upside down. A horizontal plane through the side-emitting lens of source 22 is very close to the plane of the inside ceiling 80 of optical housing/heat sink 24 (see FIG. 11C). The LED lens spreads light radially generally in its horizontal plane. But note how side members 90 (particular inner-facing sides 96, as opposed to outer side portions 92, 94, and 98) are directly in line, on opposite lateral sides of source 22, with the side-emitted beam. Likewise, inside reflective surface 34 (in front of source 22, and back reflective surface 36 (close and behind source 22), with top surface 80 (see FIG. 5C) and side members 90, basically box-in the side-emitted radial radiation from source 22 (see FIGS. 11C-D). As noted earlier, the front wall 87 of heat sink 24 basically hides LED 22 from view. Therefore, the initial radiation from side emitting LED 22 does not travel directly out of fixture 10. Rather, it is controlled to produce the rectangular pattern 40 (FIG. 11A) having sides AC and BD elongated in opposite lateral directions defining a relatively long beam length, and sides AB and CD defining a relatively narrow beam width. Note in FIGS. 8A-B and 9A-B that notches 35 and 37 respectively, can be formed in pieces 34 and 36 for clearance of the base of the light source 22.

As indicated roughly in FIGS. 11A-E, the radial side-emitted light from source 22 is manipulated in at least the following ways. The inside reflective surface 34 is tilted forwardly slightly to receive direct radial light from source 22 all along its length and reflect it efficiently down and back towards convex reflective back surface 36. Back surface 36 then re-reflects that light downwardly but forwardly (see FIG. 11E). But because of its curved convex shape (in the horizontal plane), it also spreads that light laterally in both directions (see FIGS. 11B and D). These components and their cooperation are selected to produce the rectangular pattern 40. But also, they are selected to generally produce at least somewhat even intensity throughout pattern 40. This is accomplished by enclosing source 22 in the box-like structure that includes surfaces 34 and 36, as well as ceiling 80 and the inner surfaces of side members 90. The elongated lateral or horizontal length of surfaces 34 and 36, and the placing of the source 22 along the middle of those pieces, is intended to distribute increasingly more light in the pattern 40 farther away from source 22. Those portions will be placed in the pattern to achieve general uniformity of intensity throughout the illumination. This can be achieved using empirical methods by and knowledge of those skilled in the art.

As indicated in FIGS. 11A-E, cut-off at sides AB, CD, AC, and AD of beam pattern 40 can be somewhat sharp. This is controlled by reflecting the radial side emitting pattern of LED 22 off of rectangular-shaped reflective surfaces 34 and 36, as well as positioning of the side members 90. One skilled in the art can adjust these things to achieve variations in the beam pattern.

The reflective surfaces of pieces 34 or 36 could be integral to those pieces. Alternatively, they could be a layer or coating that is applied over a substrate or support member. Note that surface 36 can be on one side of a piece of relatively uniform thickness that is formed into a curved shape. Mounting holes 68 in heat sink 24, and through-holes 70 in piece 36, can be designed so that mounting of piece 36 to heat sink 24 will hold piece 36 in compression to urge it to bulge out and retain its curved shape and resist flattening out. There could be spacers or supporting material behind it to help retain its shape.

E. Method and Embodiment 2

Figure 2A:
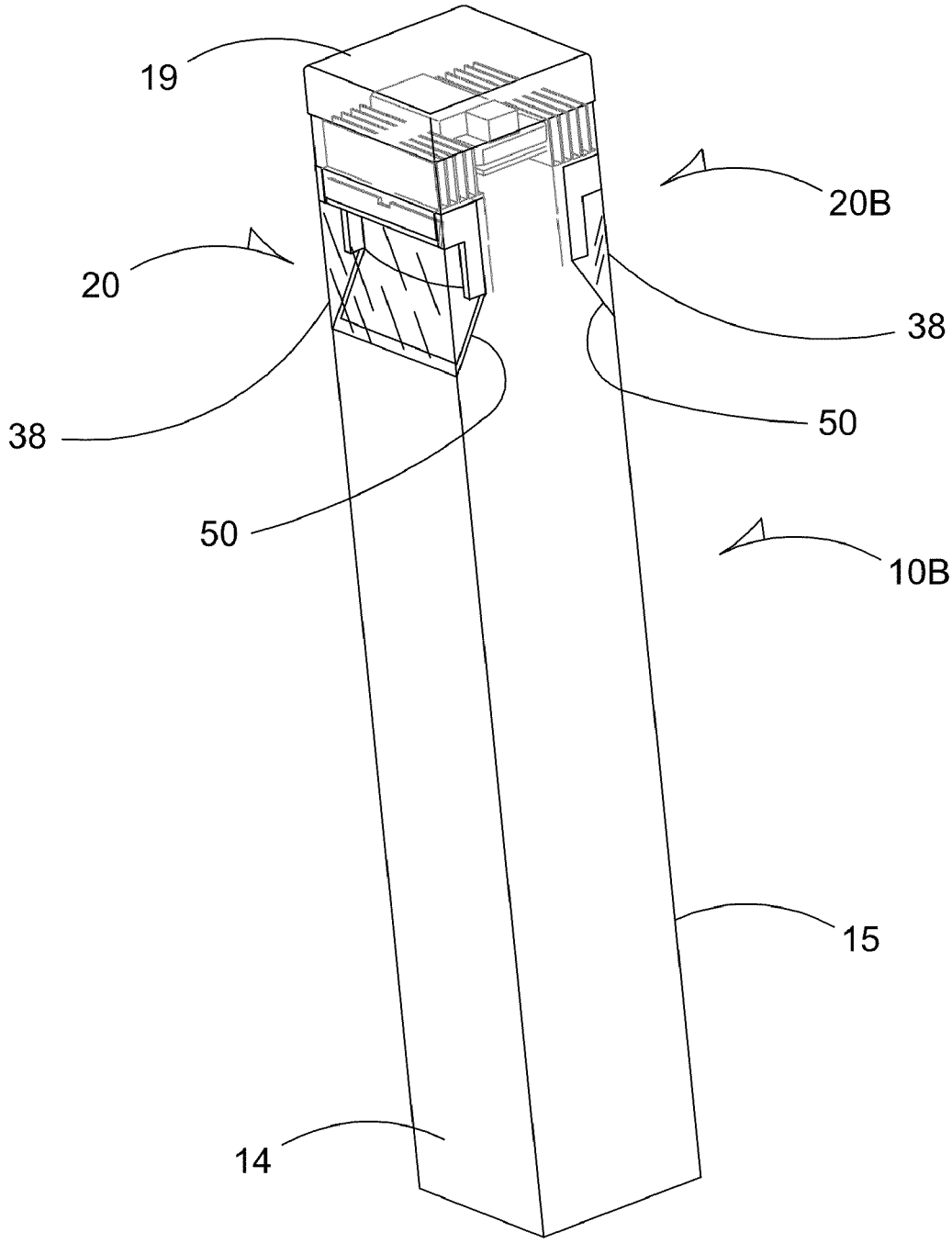
FIG. 2A is a perspective view of a second exemplary embodiment according to the present invention, having light output patterns from opposite sides of the device.
Figure 2B:
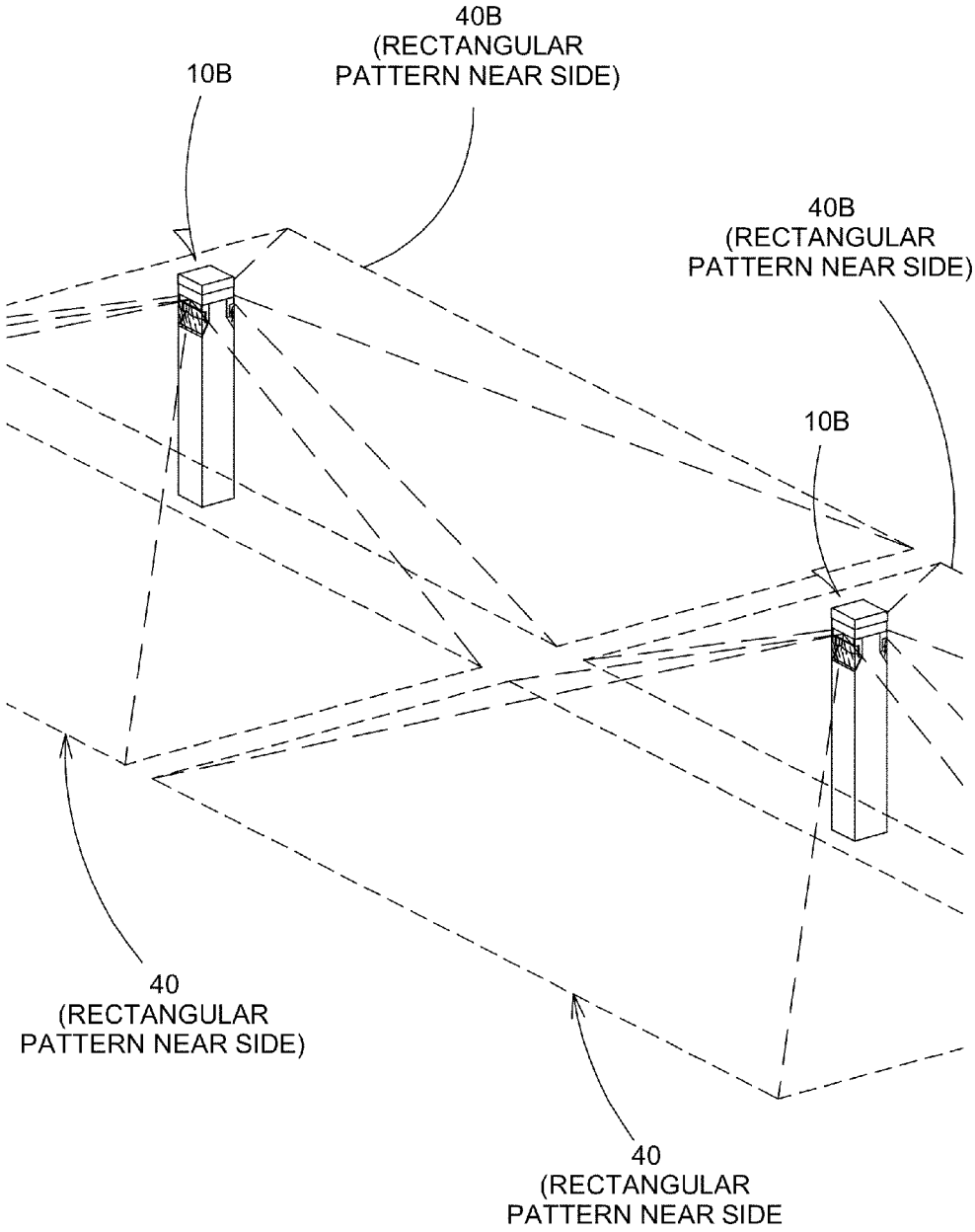
FIG. 2B is similar to FIG. 1B but with two embodiments of FIG. 2A.
Figure 2C:
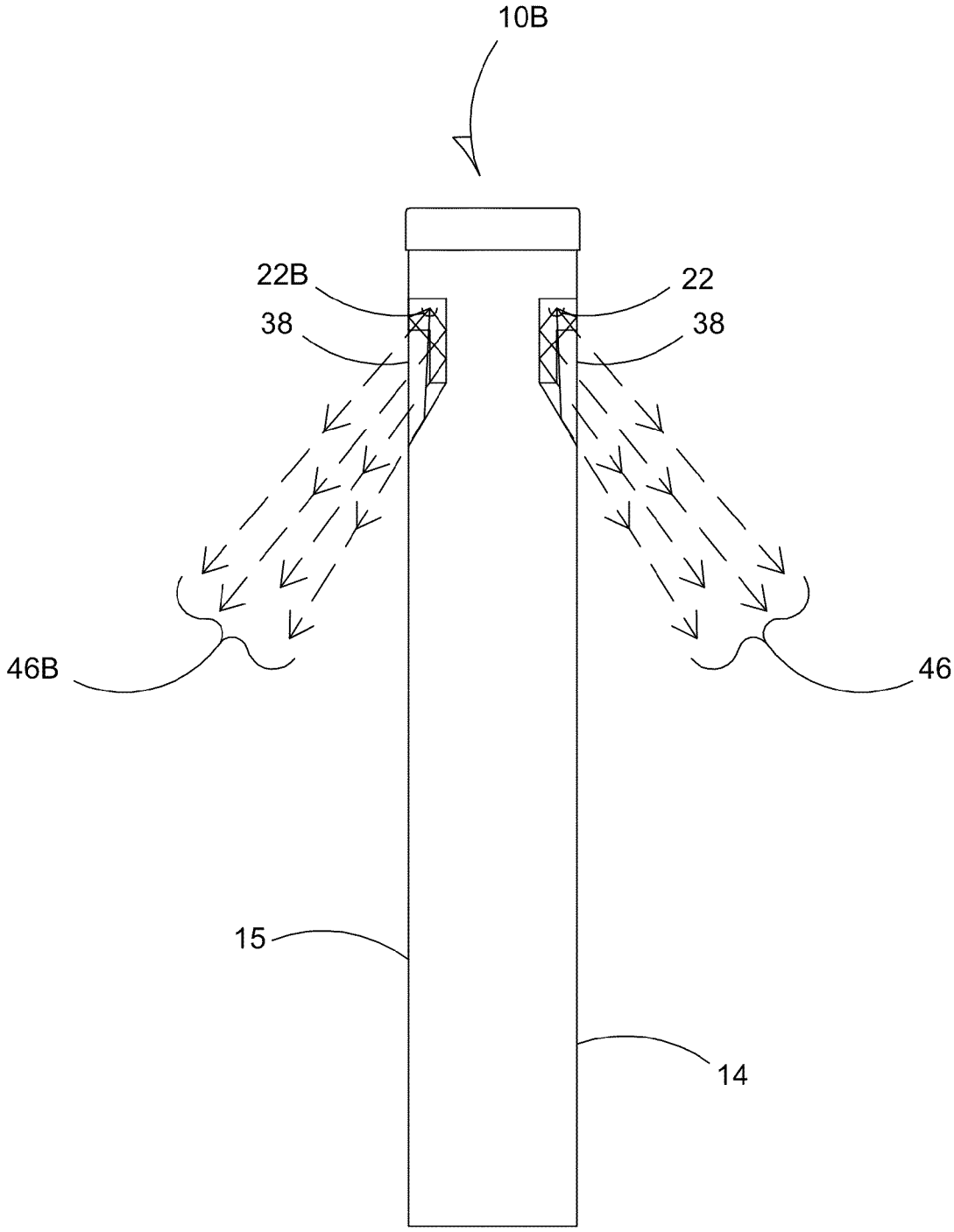
FIG. 2C is a side elevation view showing diagrammatically light output patterns from the device of FIG. 2A.

FIGS. 2A-C illustrate another exemplary embodiment according to the invention. A fixture 10B would use most of the same or similar components to those of embodiment 1, but create a second cut-out 50 on the back side 15 of post 12, install a second optical assembly (optical housing/heat sink 24 with reflective surfaces 34 and 36, and second LED 22). This would not only provide light output 40 from the front side 14, as discussed above, but another pattern 40B from the opposite side. FIGS. 2A-C illustrate this embodiment two. This embodiment 10B is used to illuminate two different areas from within a single fixture location. The front and back light patterns 40 and 40B can be identical or different to suit the needs of each area by design and selection of the light sources and optic system. The Options and Alternates section, set forth later, will discuss ways to alter the light beam size and shape.

Post housing 12 for embodiment two contains notch 50 in front face 14 and a second notch 50 in back face 15 to accept a second optic housing 24. A single electrical circuit board 58 could be configured to provide power and circuitry to both light sources 22 and allow for independent or simultaneous control, as required or desired.

Additional light sources 22 can be added to a single post housing 12 in similar manner. For example, an additional notch 50 could be formed in one or both of the sides between front 14 and back 15 of post 12 to project third or fourth beams from either of those sides. Alternatively, one or more additional notches 50 could be formed at other vertical height(s) on post 12 to create mounting locations for more than one beam from a single side of post 12.

F. Method and Embodiment 3

Figure 3B:
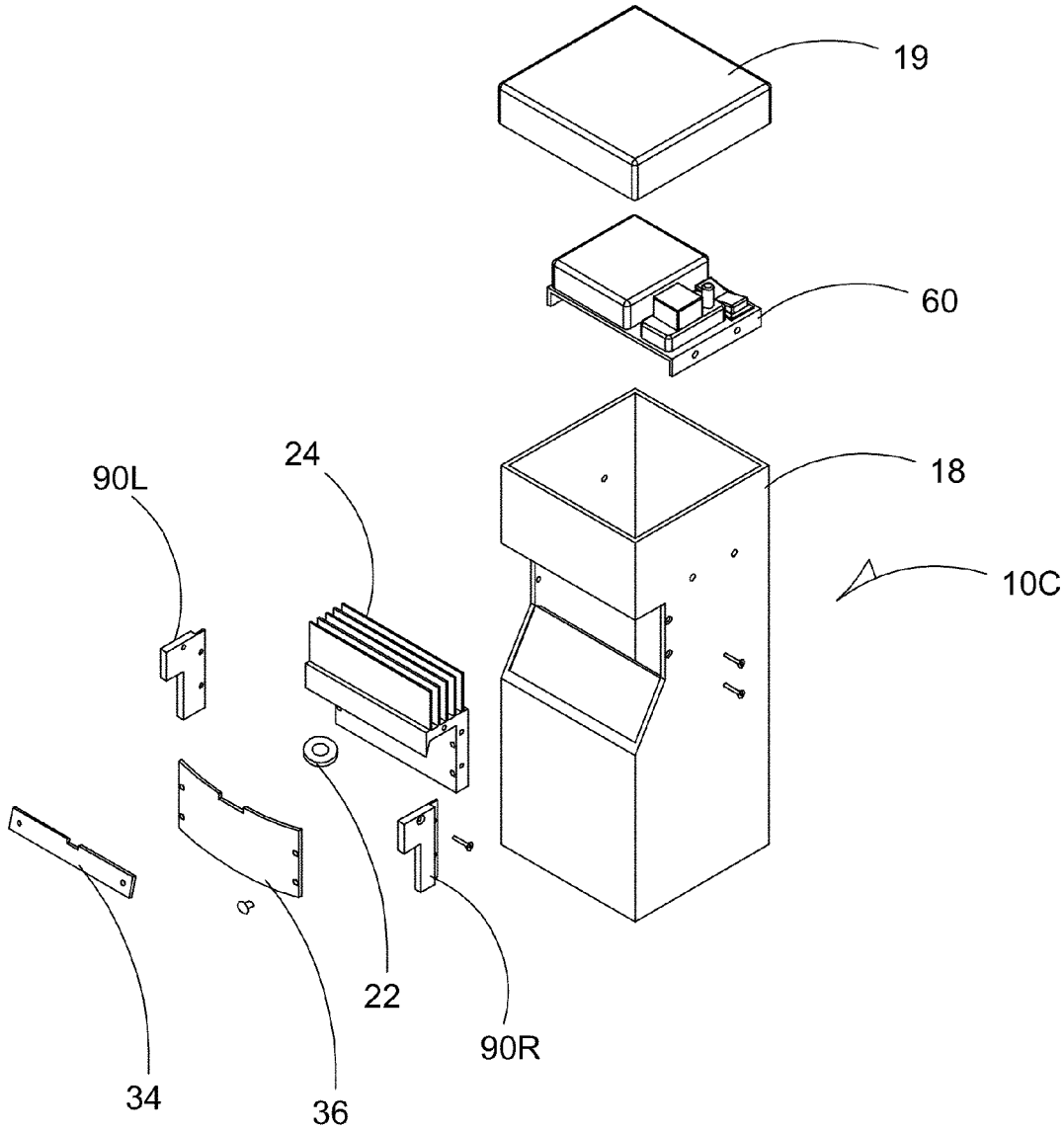
FIG. 3B is similar to FIG. 3A but for an alternative mounting housing.
Figure 4A:
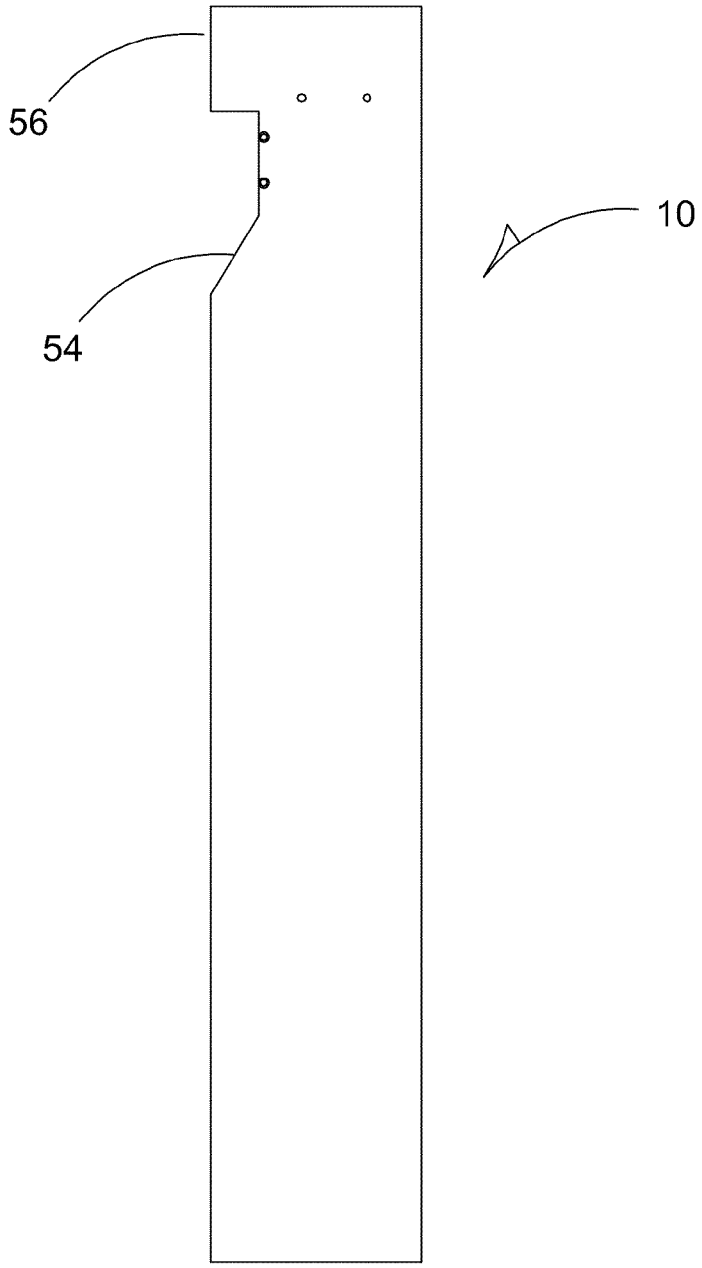
FIG. 4A is a side elevation isolated view of the base housing for FIG. 3A.
Figure 4B:
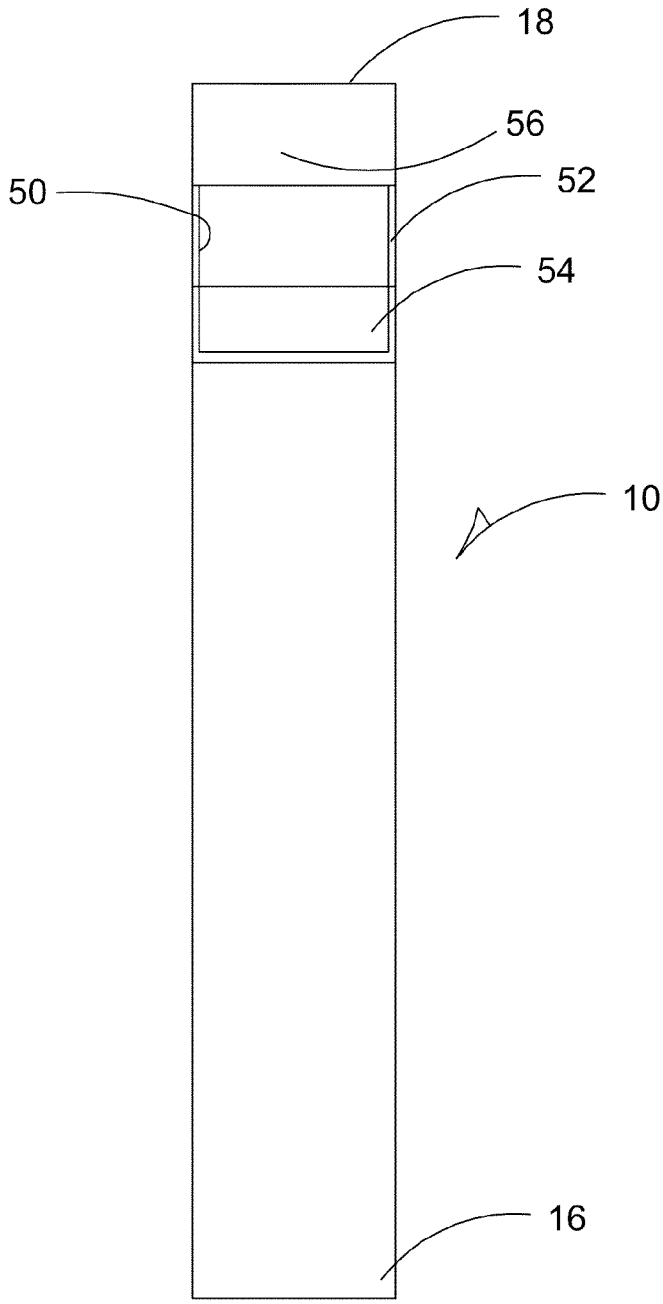
FIG. 4B is a front elevation view of FIG. 4A.
Figure 4C:
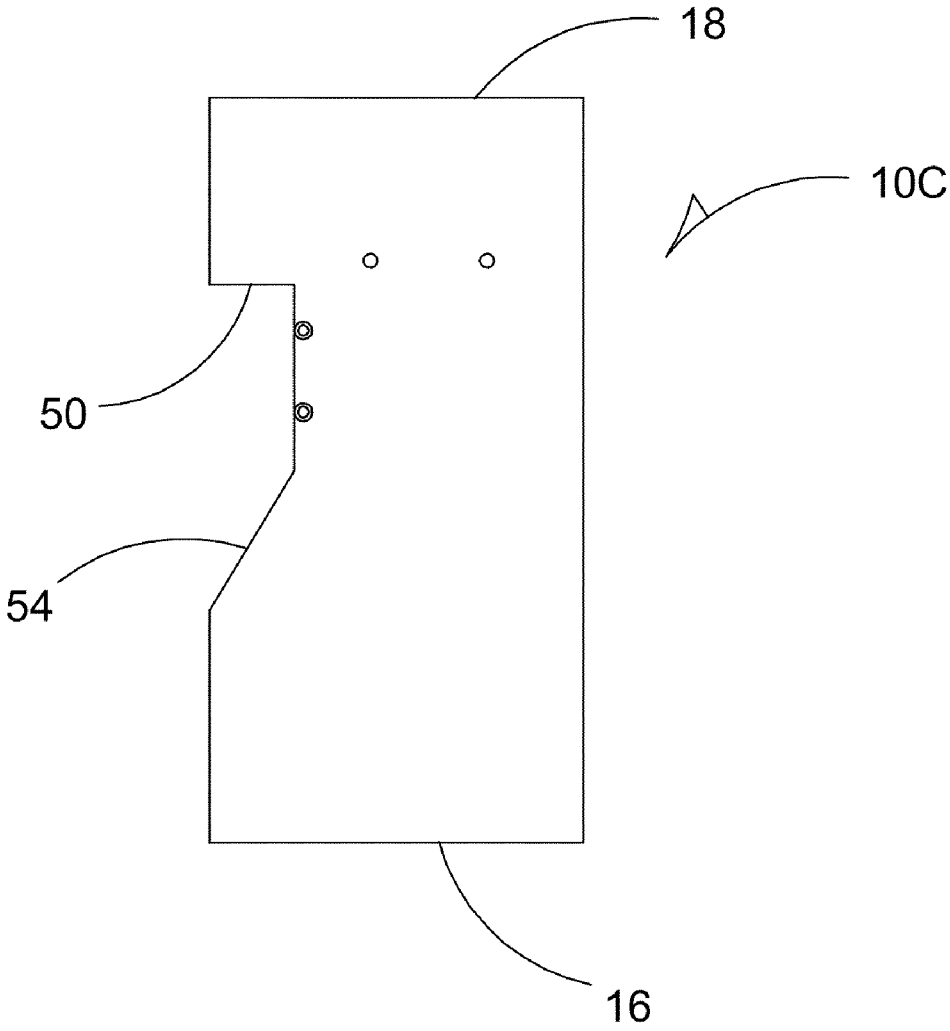
FIG. 4C is a side elevation of the isolated base housing of FIG. 3B.
Figure 4D:
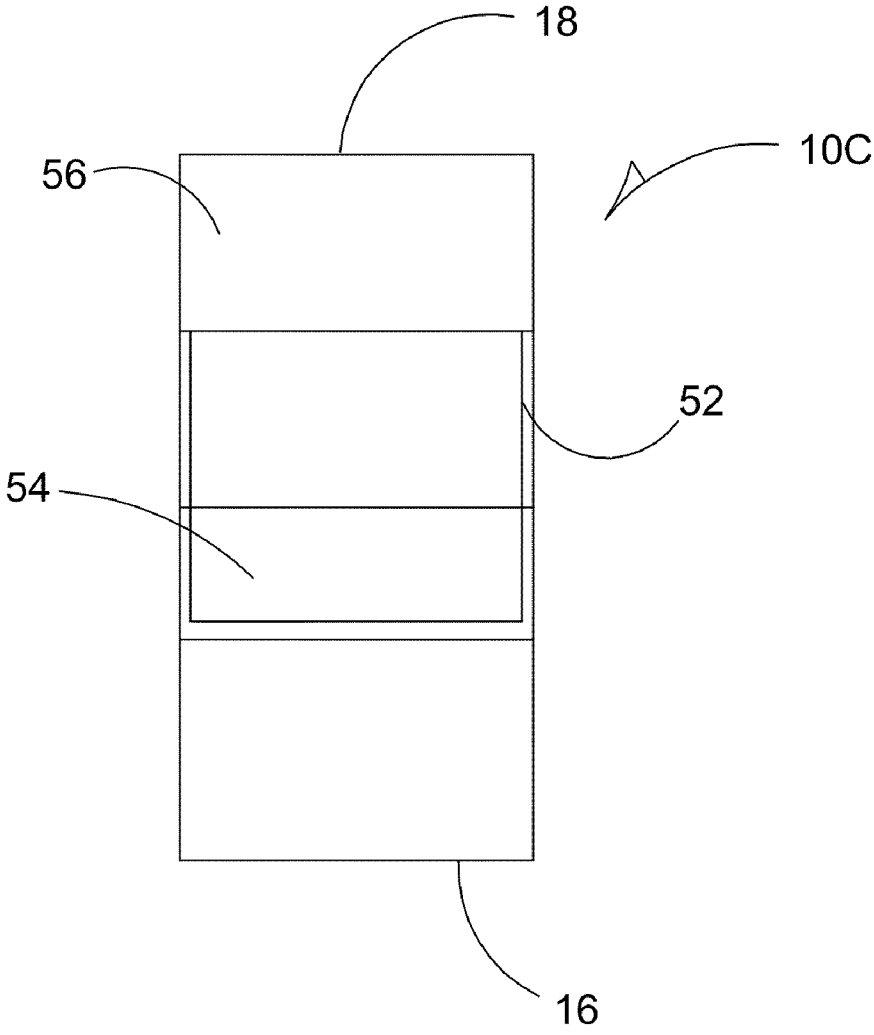
FIG. 4D is a front elevation of FIG. 4C.

FIGS. 3B and 4C-D illustrate another exemplary embodiment 10C (a third embodiment) could use many of the same or similar components of embodiment 1. The main difference is that instead of a substantially elongated post or bollard 12 of fixture 10, embodiment 10C would use a much shortened post 12. This version of the light could be used to light pathways from a position closer to the ground. Alternatively, this version 10C could essentially convert the tubular housing into a small box-like housing suitable for mounting on other supports, such as wall mounting. This embodiment 10C, when mounted along an exterior vertical wall of a building, could be used to illuminate areas that are adjacent to and along the building wall or face. The Options and Alternates section will discuss ways to alter the light beam size and shape.

Alternatively small housing 10C of FIGS. 3B and 4C-D could be mounted on top of or along another post or pole or structure (e.g., a solid square wood post).

The housing of fixture 10C can be constructed in various manners and from similar materials as embodiment 1. Construction of such a housing is familiar to those in the lighting field. The outward face contains a notch 50 similar to embodiment 1 to accept the same or a similar optic housing, light source, and other components. The electrical circuit can also be similar to embodiment 1.

G. Embodiment 4

Figures 12A, 12B:
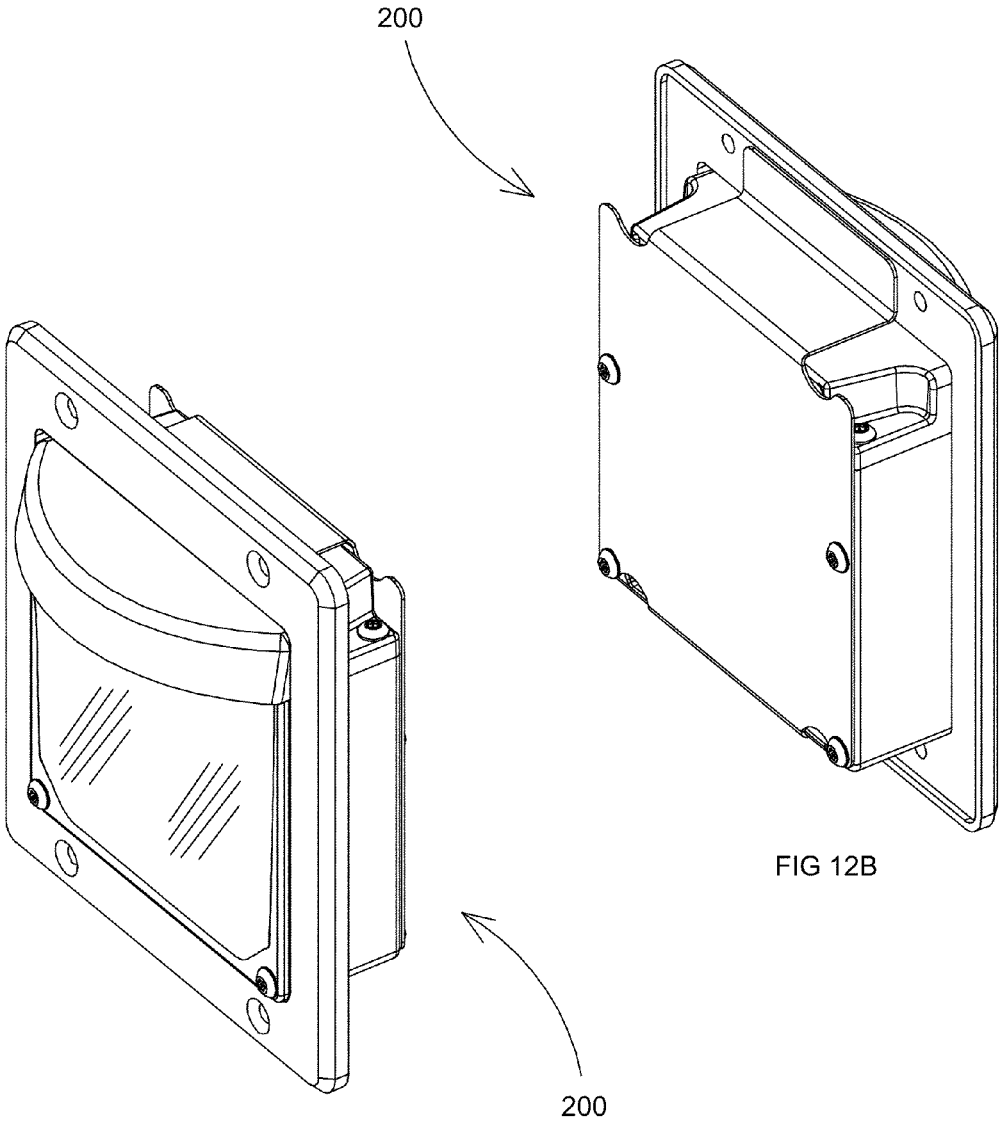
FIG. 12A is a perspective view of another embodiment according to the invention.
FIG. 12B is a perspective view of FIG. 12A from an opposite side.

Another exemplary embodiment is similar to Embodiment 1 but is designed as a self-contained unit. FIGS. 12A and B illustrate this embodiment 200 with front and back views. Embodiment 4 includes a bracket 201 which is used to attach the fixture essentially wherever desired. Among potential mounting sites are: posts, either on the surface or in notches or recesses; wall surfaces, either on the surface or in a recess, electrical-type box, etc.; or any other surface or structure. This allows the width of coverage of a pathway by the light beam to be adjusted simply by varying the angle from vertical at which the bracket is attached. If a wider beam is desired, the bottom of the mounting can be tilted (e.g., shimmed) out from the mounting surface. If a narrower beam is desired, the top of the mounting bracket can be tilted (e.g., shimmed) out from the mounting surface. Optical design is essentially similar to previous embodiments.

Embodiment 4 Optical Design

Embodiment 4 (generally at ref. No. 200) has been designed similarly to previous embodiments, however its particular design allows it to be flush mounted in a post or wall with no side notch necessary. The projection of the cap and the design of the optic system allows a 180° side beam projection within approximately one inch of the mounting surface. The following optical details are particular features of Embodiment 4 but are essentially the same in general scope as the optical details of the previous embodiments.

Figure 17:
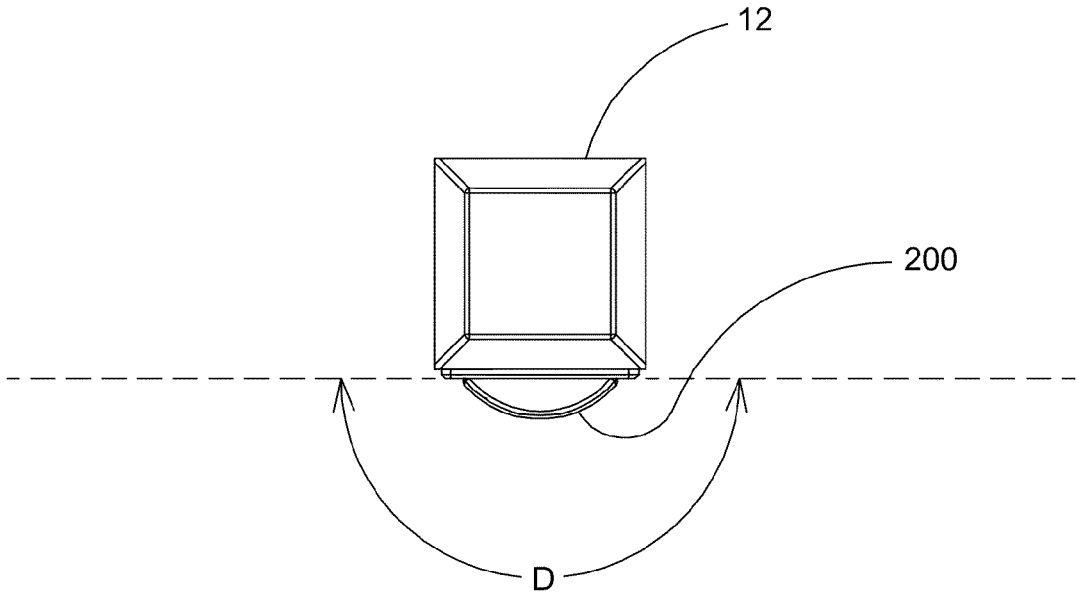
FIG. 17 is a reduced-in-size top plan view of FIG. 12A.

FIG. 17 shows a plan view of Embodiment 4 as typically installed in a post. It illustrates the horizontal beam spread ∠ D of 180°, projected on the ground within approximately one inch of the mounting surface (from a mounting height of 2.5 feet). This means that because of the optical design, the fixtures are able to project a beam that is relatively well defined along a straight path. This beam spread ∠ D is exemplary and could be less or more according to desired effect.

Figure 18:
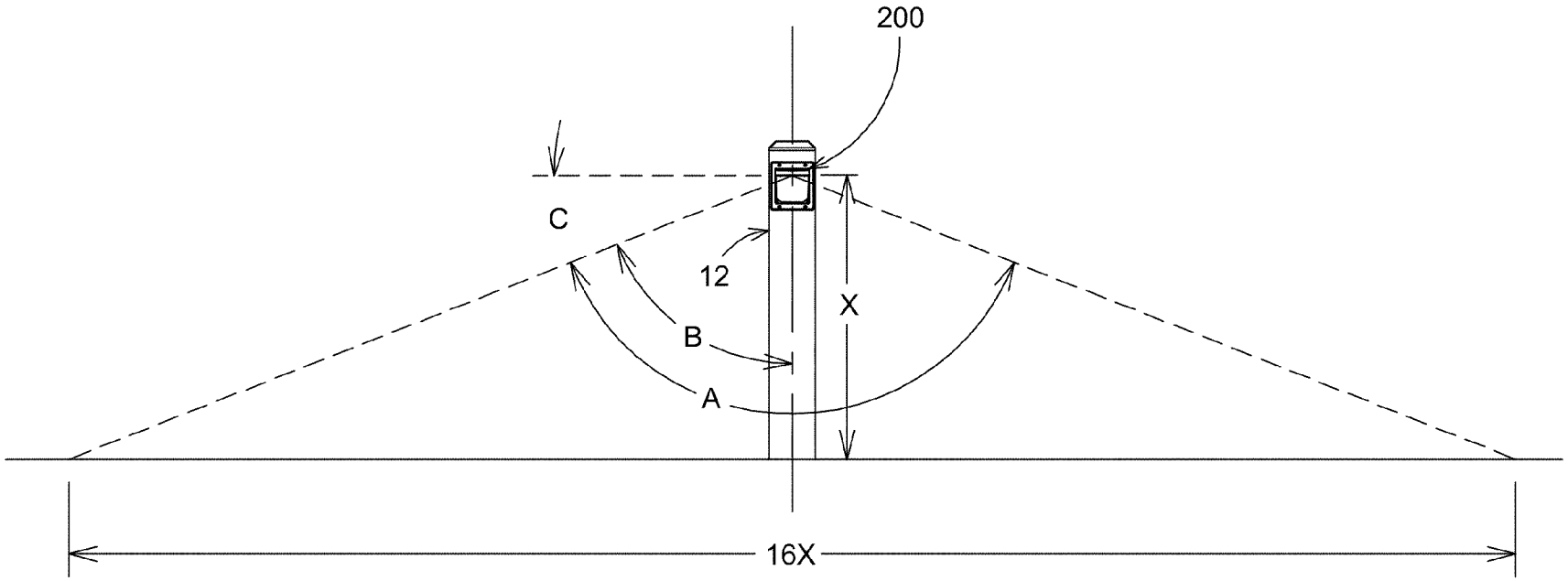
FIG. 18 is a further reduced-in-size front elevation of the embodiment of FIG. 12A mounted on the bollard.

FIG. 18 illustrates the beam spread of Embodiment 4. As embodied, the light emitted side-to-side has a total beam spread ∠ A of 140°, or ∠ B 70° from nadir, which is ∠ C 20° from horizontal. An additional alternative embodiment has a beam spread of ∠ A of 110°, or ∠ B 55° from nadir, which is ∠ C 35° from horizontal. These angles are exemplary and allow for different placement of the fixtures to achieve desired light levels, spacings between fixtures, coverage, etc. Other angles/beam spreads could be designed as well.

FIG. 18 also shows an exemplary beam pattern viewed from the front. It illustrates that as embodied (using the previously mentioned total beam spread ∠ A of 140°), the length (e.g., along a pathway) of the beam is approximately 16 times the mounting height of the fixture. Thus a mounting height of 2.5 feet would give a total beam length along a pathway of 40 feet. A mounting height of 5 feet would give a total beam length along a pathway of 80 feet, and so on. This would allow for differing designs, LED power levels, etc. in order to meet the needs of a particular situation. Different designs for beam spread angles would of course provide additional options for beam length.

Figure 19:
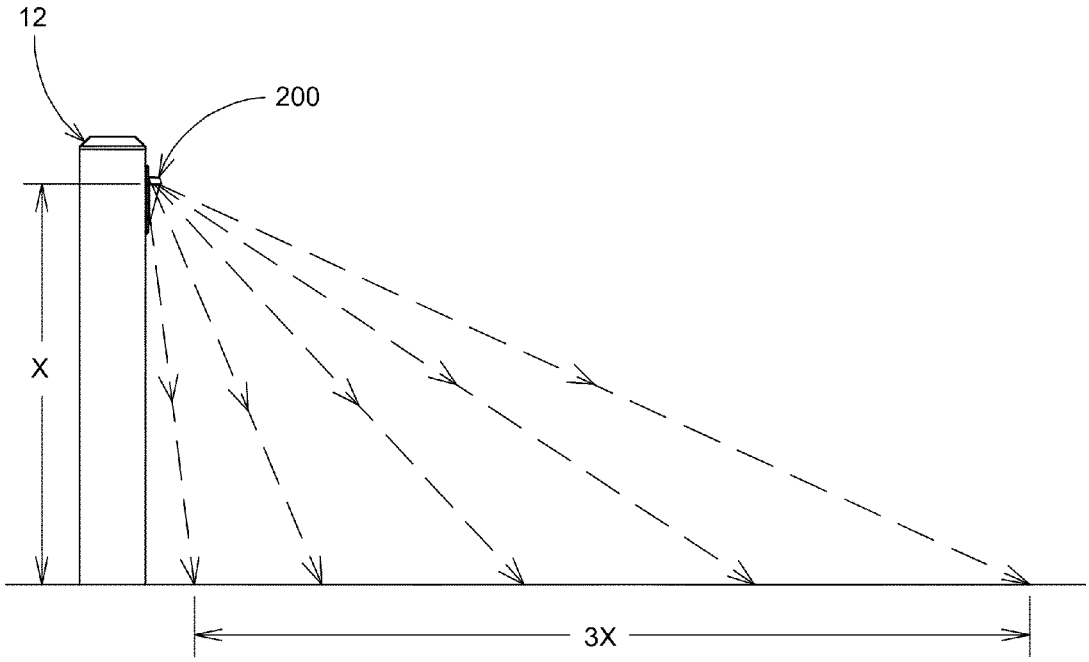
FIG. 19 is a side elevational view of FIG. 18.

FIG. 19 illustrates a similar projection of an exemplary beam pattern as embodied, showing that from the side, when the fixture is mounted essentially vertically, the beam pattern is approximately 3 times the mounting height of the fixture. Thus a mounting height of 2.5 feet would give a total beam pattern across the width of a pathway of 7.5 feet. A mounting height of 5 feet would give a total beam pattern across the width of a pathway of 15 feet, and so on. Again, this would allow for differing designs, LED power levels, etc. in order to meet the needs of a particular situation. Different designs for beam patterns would of course provide additional options for beam width across pathways, etc.

Details of Embodiment 4

Figure 13:
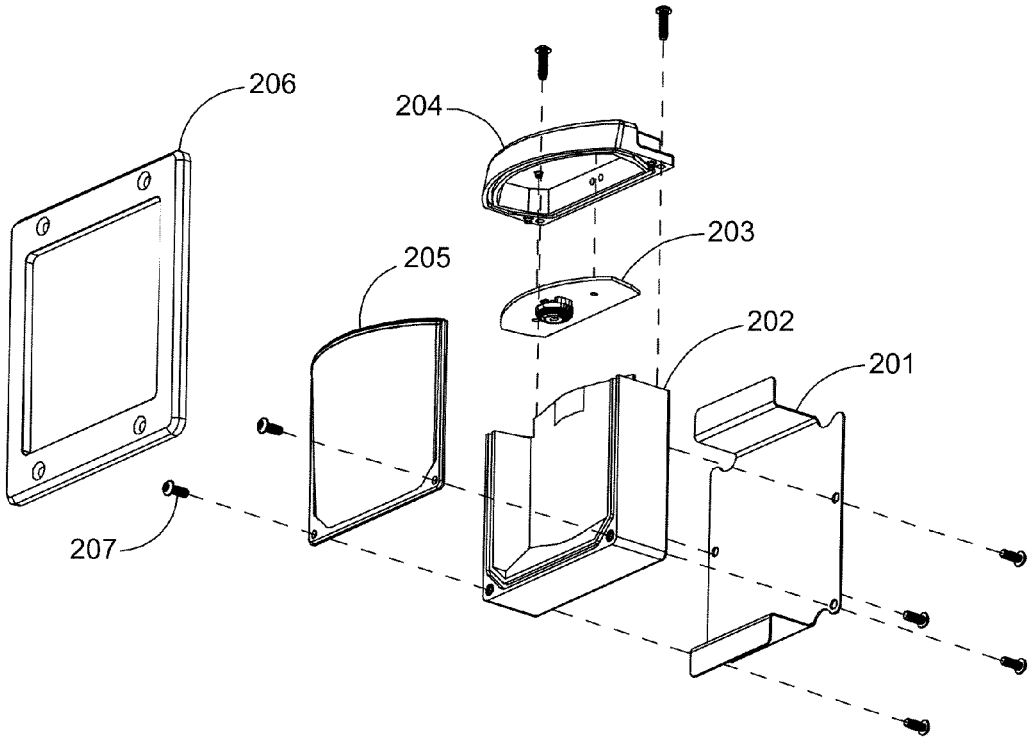
FIG. 13 is an exploded view of FIG. 12A.
Figure 14A:
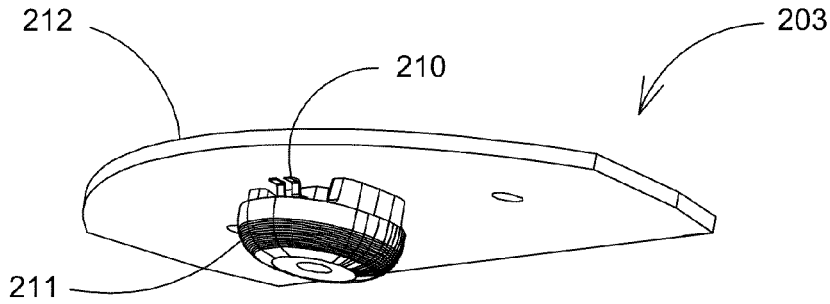
FIG. 14A is an enlarged perspective view of a light source of the embodiment of FIG. 13.
Figure 14B:
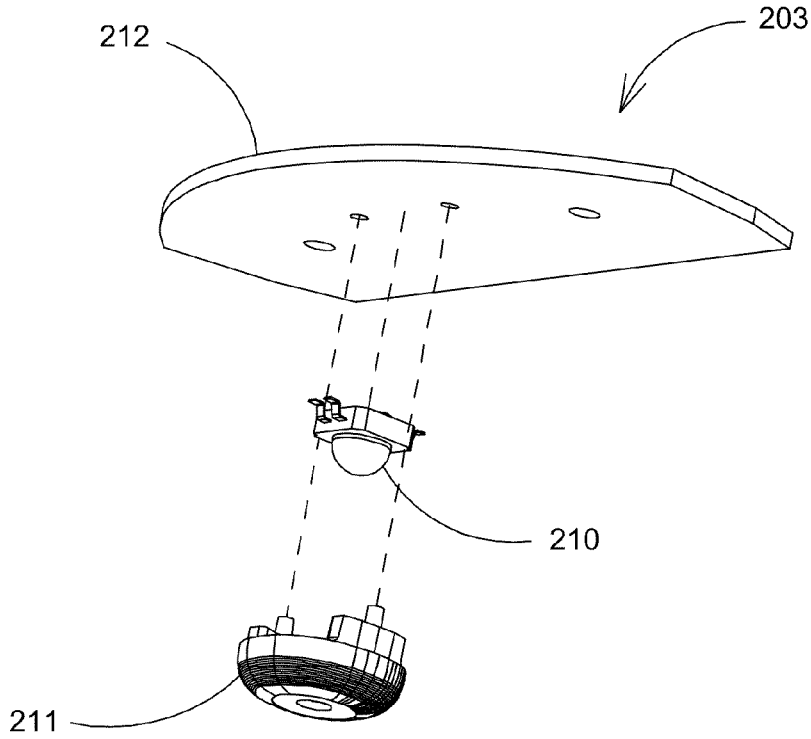
FIG. 14B is an exploded view of FIG. 14A.

Embodiment 4 of FIGS. 12A and B, is illustrated in exploded view in FIG. 13. It comprises a bracket 201 which is attached to the main housing/reflector 202. The main housing includes the cap 204, LED circuit board assembly 203, front lens 205, and bezel 206. Circuit board assembly 203, FIG. 14A/14B, includes LED 210, lens 211, circuit board 212. In this embodiment, LED 210 emits a Lambertian pattern. Lens 211 converts the beam to a non-Lambertian pattern. Screws 207, FIG. 13 or other fastening means may be used to assemble the components.

Figure 16:
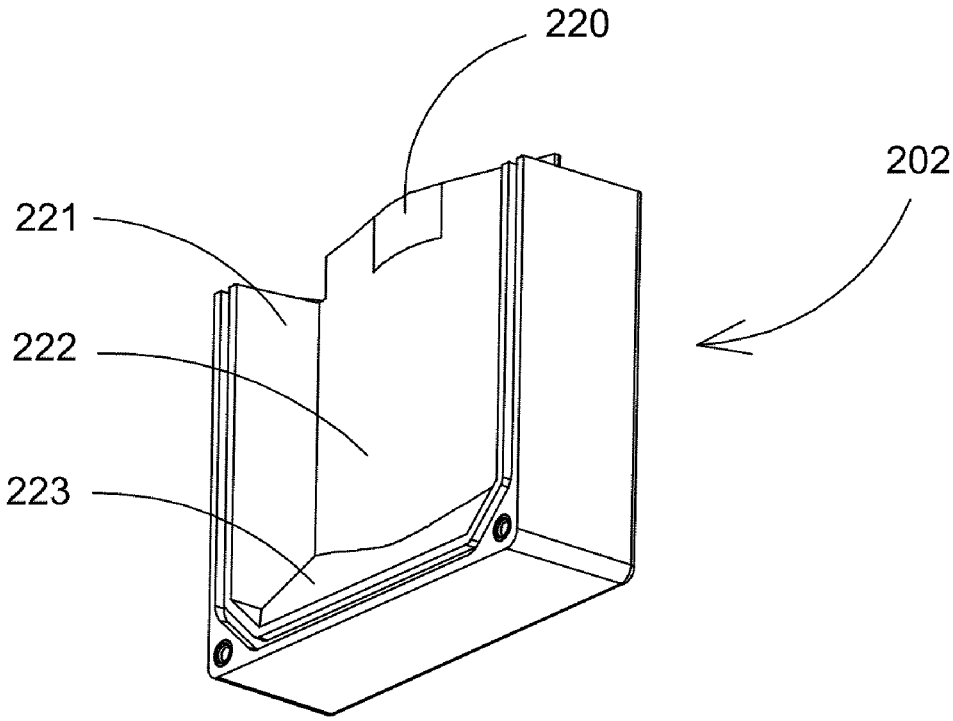
FIG. 16 is a perspective view of a base housing of the embodiment of FIG. 13.

Main housing 202, FIG. 16, has reflective surfaces which control and direct the light to the target area. Surface 222 is generally convex relative to a horizontal plane. Surface 221 and its companion on the opposite side are reflective as well and reflect light to the sides. Surface 223 reflects light from the LED generally forward. Surface 220 is an optional reflective field within surface 222 having a different surface texture. This surface helps to soften and disperse light which could otherwise tend to create a "hot spot" of illumination directly in front of the fixture.

The reflective surfaces could be metallized surface deposited on an injection molded substrate having a specific surface texture. Alternatively, they could be machined as part of the housing, which could be aluminum or other material, then polished or treated to a specific surface texture. The reflective surfaces could also be separate pieces of reflective material such as metallized plastic, reflective film, polished aluminum, or other materials which can be manufactured to a specific surface texture and reflectivity. Reflective surface 220 could be formed simply by creating a different texture on a die-casting mold, by using a different machining process from the rest of the reflective surface 222, or applying a film or reflectorized component.

Figure 15A:
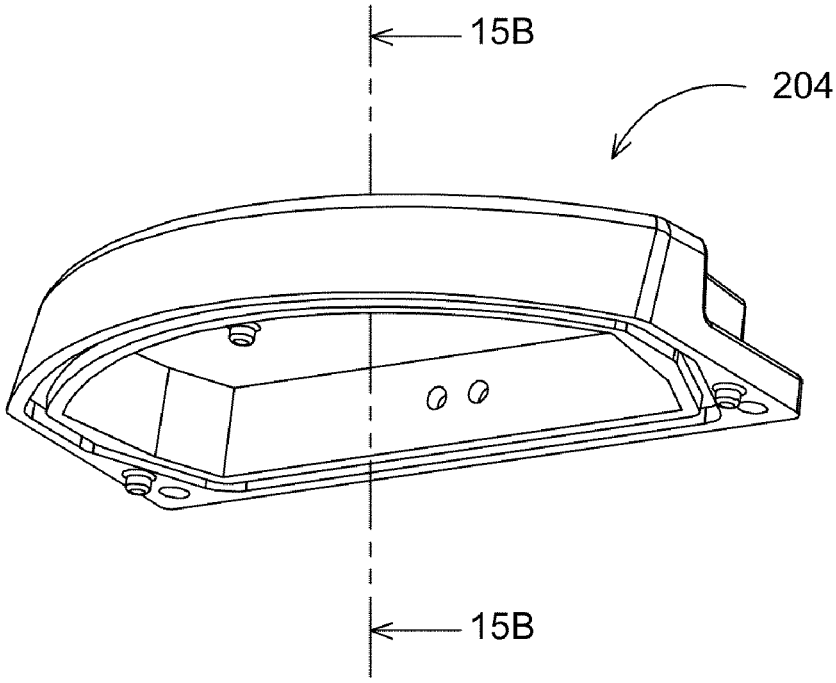
FIG. 15A is a perspective view of the cap of the embodiment of FIG. 13.
Figure 15B:
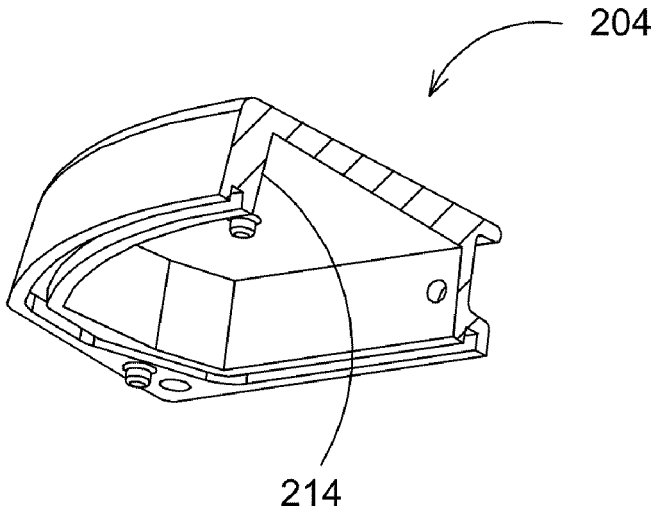
FIG. 15B is a sectional view of FIG. 15A along line 15B-15B.

The front face 214, FIG. 15B, of the cap 204 is sloped slightly outwardly to throw a portion of the light forward while redirecting another portion back towards the curved main reflective surface 222, FIG. 16, along the back of the optical assembly. A heat sink in contact with circuit board assembly 203 is incorporated in the cap. The other interior surfaces of cap 204 may also have a reflective surface, depending on application.

The general shape of the reflective surfaces serves to project more of the light toward the sides and less directly in front. This approach works with the side emitting LEDs to produce a uniform rectangular light beam pattern. A transparent lens cover 205, FIG. 13, is installed on the fixture. The lens cover can be constructed of glass, high clarity acrylic or other suitable transparent material. Lens material should be constructed of UV resistant material or contain a UV resistant coating.

H. Options and Alternatives

As mentioned previously, the invention can take many forms and embodiments. The foregoing examples are but a few of those. To give some sense of options and alternatives, a few examples are given below.

1. Alternate Light Beam Patterns

The exemplary embodiments are designed to provide a long and narrow beam pattern for fairly straight pathways or areas. For curves, path junctions, areas of interest, landscape and the like, different light beam shapes might be desirable. The exemplary embodiments can be modified or constructed to accommodate these conditions. A few examples will be given for illustration of modifications that could meet different needs or applications.

A semi-specular material can be used in place of highly reflective strips or surfaces to create a wider beam pattern. The curvature of the front reflective strip 36 can also be altered to focus more of the light near the fixture location, or to follow a curve in the pathway. For path junctions, light sources can be configured perpendicular to one another to illuminate a crosspath. For landscaping areas or special areas of interest, a more circular beam shape may be desired.

Another method of modifying the size of the light beam is to vary the mounting height of the light module. As the height is increased, the length and width of the light beam is also increased. The opposite is true if the height is decreased.

For areas where light is not wanted, a shield may be used to cut off the light in that direction. For example, an opaque piece or material could be mounted in the beam path to block light from traveling to or creating intensity in an area.

To provide efficient access to different beam patterns, the optic assembly can be constructed to be modular. One optic system producing a light pattern configuration could then be easily exchanged for another optic system with a different pattern size and shape. As illustrated in the exemplary embodiments, the optic system is somewhat modular. The optical housing/heat sink 24, with attachments, can be removed as one assembly, and substituted with another (of same or different beam pattern output). The exemplary embodiments allow reflective surface 36 to be independently removed or installed. Therefore, it could be changed out, if desired. This is true, too, of reflective piece 34. Side pieces 90 of different shapes could also be substituted. Note however, that if desired, alternatively one or more of reflective member 34 or 36 could be a more permanent surface. For example, a highly reflective coating or layer or piece could be permanently applied to the relevant surface of heat sink 24. Pieces 90 could be built-in or integral in sub-housing 24. In those cases, an inventory of components 24 with different characteristics would have to be available.

2. Alternate Power and Control Methods

There are many different methods of powering the LED light sources and for providing on/off control. The LED light sources for the exemplary embodiments contemplate DC-type voltage in the range of 0-24 volts.

For 120 volt AC power, conversion to DC may be required. This can be converted at a central electrical location prior to routing to each fixture location. Alternately, an AC to DC converter can be included in the electrical system at each fixture location.

The exemplary embodiments can also be powered using a DC battery type power supply with a photovoltaic recharging system. These types of systems are commonly referred to as solar powered. The battery storage device should be sized to have some reserve capacity for days with less sun exposure and insufficient recharge power to operate the lights for the desired time.

The control system used can be as simple as turning the light 22 on and off. Alternatively, there could circuitry to provide optimal dimming levels. For on/off control, a photosensor (any of a number of commercially available types) can be installed at each fixture location or at a central location. When the sensor detects low ambient light, a signal can trigger the lights to turn on. Another simple on/off control is with a time sensor that allows power to the lights for a set period of time and prevents power for an "off" time. A more sophisticated system of control may be a remote control system such as the commercially available Control-Link® system, as provided by Musco Corporation of Oskaloosa, Iowa, (USA).

A motion or occupancy detection type sensor can also be used to trigger the lights to turn on. A time delay could be used with this method to keep the lights on for a preset period. The sensor could be centrally located, or individually located at each fixture. In addition, the sensors could be networked together to allow any of the sensors to provide the signal to activate the lights. Commercially available components exist for these purposes and one of skill in the art could install them into the system.

The light fixtures and the control method can be networked together to allow for groups or regions of lights to respond together. The group of lights could then be turned on or off together, or even dimmed together.

Any combination of the above features could be used.

3. Alternate Light Sources

Embodiment one uses a solid state light source, specifically a high power LED source. However, alternative solid state light source are included in this invention. Alternately, non-solid state light sources that are compact, but provide high lumen output per watt of energy can also be considered. Still further, less efficient light sources (including incandescent) could be used.

What is claimed is:

1. A bollard-type light comprising:

a. an elongated housing having an opening along a side into an interior space;

b. a light source mounted within the interior space and generating a radiation pattern; and c. at least one reflective surface which captures a substantial amount of the radiation from the radiation pattern and creates a controlled output pattern with relatively defined perimeter edges, wherein a first said reflective surface is elongated in the horizontal direction and is positioned in the radiation pattern in front of the light source and directs incident light back towards the direction of the light but somewhat downwardly and a second said reflective surface reflects incident light from the first reflective surface forwardly and out of the opening, but spreads light in opposite lateral directions.

2. The light of claim 1 further comprising shielding the light source from most direct views.

3. The light of claim 2 further comprising placing blocking surfaces relative the light source and the reflecting surfaces to assist in control of perimeter cut-off of the pattern.

4. The light of claim 1 further comprising spreading the light so that the pattern has relatively even intensity throughout the pattern.

5. A lighting fixture comprising:

a. a housing;

b. an interior chamber in the housing, the interior chamber defined by a top, a bottom, a front, a back, and opposite sides;

c. a light source mounted at or towards the top of the interior chamber and adapted to produce a light source output pattern;

d. an opening in the housing to the front of the interior chamber having perimeter margins beginning below the light source and extending towards the bottom of the interior chamber;

e. a reflective surface at or near the back of the interior chamber and adapted to spread incident light from the light source output pattern of the light source substantially evenly out the opening of the housing, outwardly, downwardly, and divergingly laterally relative the bottom and opposite sides of the interior chamber;

f. the perimeter margins of the opening positioned relative to the light spread by the reflective surface to assist in producing relatively sharp outer margins of a fixture light output pattern.

6. The lighting fixture of claim 5 further comprising a second reflective surface facing the light source between the top and front of the interior of the chamber and the light source and adapted to reflect incident light from the light source output pattern to the reflective surface at or near the back of the interior chamber.

7. The lighting fixture of claim 5 further comprising a third reflective surface at each opposite side of the interior chamber and adapted to reflect incident light from the light source output pattern within the fixture light output pattern.

8. The lighting fixture of claim 5 further comprising a fourth reflective surface at the bottom of the interior chamber and adapted to reflect incident light from the light source output pattern within the fixture light output pattern.

9. The lighting fixture of claim 5 further comprising a lens over the opening.

10. The lighting fixture of claim 5 wherein the light source comprises a solid state light source.

11. The lighting fixture of claim 10 wherein the solid state light source comprising a side emitting LED.

12. The lighting fixture of claim 10 further comprising a member comprising a mounting surface and a heat sink for the solid state light source.

13. The lighting fixture of claim 5 wherein the light source output pattern is substantially side-emitting, bat wing, or Lambertian.

14. The lighting fixture of claim 5 wherein the reflective surface at or near the back of the interior chamber is a removable component.

15. The lighting fixture of claim 5 wherein the reflective surface at or near the back of the interior chamber is integrated with the housing.

16. The lighting fixture of claim 5 wherein the reflective surface at or near the back of the interior chamber is at least substantially convex relative to one axis.

17. The lighting fixture of claim 5 further comprising a mounting structure associated with the housing adapted to mount the fixture to a support.

18. The lighting fixture of claim 17 wherein the mounting structure comprises a receiver for a vertical post.

19. The lighting fixture of claim 17 wherein the mounting structure comprises a bracket adapted for attachment to a vertical surface.

* * * * *